US009090077B2

(12) United States Patent
Shimizu et al.

(10) Patent No.: US 9,090,077 B2
(45) Date of Patent: Jul. 28, 2015

(54) LIQUID CONTAINER

(71) Applicant: CANON KABUSHIKI KAISHA, Tokyo (JP)

(72) Inventors: Eiichiro Shimizu, Hong Kong (CN); Hajime Yamamoto, Tokyo (JP); Yukuo Yamaguchi, Tokyo (JP); Kenjiro Watanabe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 13 days.

(21) Appl. No.: 14/267,785

(22) Filed: May 1, 2014

(65) Prior Publication Data

US 2014/0240413 A1 Aug. 28, 2014

Related U.S. Application Data

(62) Division of application No. 13/543,716, filed on Jul. 6, 2012, now Pat. No. 8,764,171, which is a division of application No. 12/721,425, filed on Mar. 10, 2010, now Pat. No. 8,376,535, which is a division of (Continued)

(30) Foreign Application Priority Data

Dec. 26, 2003 (JP) ..... 2003-435940

(51) Int. Cl.
*B41J 2/15* (2006.01)
*B41J 2/175* (2006.01)

(52) U.S. Cl.
CPC ..... *B41J 2/1752* (2013.01); *B41J 2/17546* (2013.01)

(58) Field of Classification Search
CPC ..... B41J 2/175; B41J 29/13; B41J 2/14; B41J 2002/14491; B41J 2002/11; B41J 2/14145
See application file for complete search history.

(56) References Cited

U.S. PATENT DOCUMENTS 5,138,344 A 8/1992 Ujita ..... 347/86
5,400,066 A 3/1995 Matsumoto et al. ..... 347/86

(Continued)

FOREIGN PATENT DOCUMENTS

CN 1081551 C 3/2002
DE 102006028077 4/2007

(Continued)

OTHER PUBLICATIONS

Russian Decision to Grant, dated May 3, 2006, in Russian counterpart Application No. 2004138031, with English translation.

(Continued)

*Primary Examiner* — Lamson Nguyen
(74) *Attorney, Agent, or Firm* — Fitzpatrick, Cella, Harper & Scinto

(57) ABSTRACT

A liquid container detachably mountable to first and second locking portions of a mounting portion of an apparatus. The liquid container includes a casing for containing liquid and a supply port for supplying the liquid to an ink jet head. At respective first and second sides of the casing, first and second engaging portions are provided, respectively engageable with the first and second locking portions. A supporting member displaceably supports the second engaging portion, and a contact is contactable to a member provided in the mounting portion to permit of display information relating to the liquid container. The supply port is disposed in a third side of the casing which is between the first and second sides, and the contact is disposed at a corner region between the second and third sides.

28 Claims, 15 Drawing Sheets

Related U.S. Application Data application No. 11/473,063, filed on Jun. 23, 2006, now Pat. No. 7,717,541, which is a division of application No. 11/016,914, filed on Dec. 21, 2004, now Pat. No. 7,278,721.

(56) References Cited

U.S. PATENT DOCUMENTS

| | | | | |
|---|---|---|---|---|
| 5,506,611 | A | 4/1996 | Ujita et al. | 347/86 |
| 5,583,549 | A | 12/1996 | Ujita et al. | 347/86 |
| 5,610,635 | A | 3/1997 | Murray et al. | 347/7 |
| 5,619,237 | A | 4/1997 | Inoue et al. | 347/86 |
| 5,788,388 | A | 8/1998 | Cowger et al. | 400/703 |
| 5,861,901 | A | 1/1999 | Kashimura et al. | 347/50 |
| 5,940,102 | A | 8/1999 | Watanabe et al. | 347/86 |
| 6,062,667 | A | 5/2000 | Matsui et al. | 347/19 |
| 6,102,518 | A | 8/2000 | Taylor | 347/29 |
| 6,130,695 | A | 10/2000 | Childers et al. | 347/85 |
| 6,151,051 | A | 11/2000 | Matsui et al. | 347/19 |
| 6,196,670 | B1 | 3/2001 | Saruta | 347/86 |
| 6,302,535 | B1 | 10/2001 | Sturgeon et al. | 347/86 |
| 6,336,709 | B1 | 1/2002 | Inoue et al. | 347/49 |
| 6,402,310 | B1 | 6/2002 | Maeda et al. | 347/87 |
| 6,431,681 | B2 | 8/2002 | Hatasa et al. | 347/19 |
| 6,454,381 | B1 | 9/2002 | Olsen et al. | 347/19 |
| 6,502,917 | B1 | 1/2003 | Shinada et al. | 347/19 |
| 6,554,411 | B1 | 4/2003 | Hatasa et al. | 347/86 |
| 6,609,788 | B2 | 8/2003 | Hatasa et al. | 237/86 |
| 6,702,427 | B2 | 3/2004 | Shimizu et al. | 347/50 |
| 6,742,857 | B2 | 6/2004 | Koshikawa et al. | 347/19 |
| 6,742,872 | B2 | 6/2004 | Fukazawa et al. | 347/50 |
| 6,802,586 | B2 | 10/2004 | Forman | 347/19 |
| 6,808,256 | B2 | 10/2004 | Umeyama et al. | 347/87 |
| 6,815,381 | B1 | 11/2004 | Yamamoto et al. | 442/187 |
| 6,824,258 | B2 | 11/2004 | Yamamoto et al. | 347/86 |
| 6,869,158 | B2 | 3/2005 | Kojima et al. | 347/19 |
| 6,935,716 | B2 | 8/2005 | Hatasa et al. | 347/19 |
| 7,029,104 | B2 | 4/2006 | Sakai et al. | 347/86 |
| 7,118,204 | B2 | 10/2006 | Hatasa et al. | 347/86 |
| 7,150,520 | B2 | 12/2006 | Shinada et al. | 347/86 |
| 7,152,953 | B2 | 12/2006 | Haan et al. | 347/49 |
| 7,192,107 | B2 | 3/2007 | Fukano et al. | 347/7 |
| 7,278,721 | B2 * | 10/2007 | Shimizu et al. | 347/86 |
| 7,717,541 | B2 | 5/2010 | Shimizu et al. | 347/49 |
| 2001/0015738 | A1 | 8/2001 | Childers | 347/49 |
| 2002/0085075 | A1 | 7/2002 | Shinada et al. | 347/86 |
| 2002/0175979 | A1 | 11/2002 | Morita et al. | 347/86 |
| 2003/0085970 | A1 | 5/2003 | Sakai et al. | 347/86 |
| 2003/0214559 | A1 | 11/2003 | Shinada et al. | 347/50 |
| 2003/0215280 | A1 | 11/2003 | Hatasa et al. | 401/132 |
| 2003/0227501 | A1 | 12/2003 | Hatasa et al. | 347/19 |
| 2003/0234844 | A1 | 12/2003 | Yamamoto et al. | 347/86 |
| 2004/0100540 | A1 | 5/2004 | Hatasa et al. | 347/86 |
| 2005/0007420 | A1 | 1/2005 | Ogawa et al. | 347/50 |
| 2005/0036016 | A1 | 2/2005 | Watanabe et al. | 347/86 |
| 2005/0151811 | A1 | 7/2005 | Shimizu et al. | 347/86 |
| 2005/0179750 | A1 | 8/2005 | Hayasaki et al. | 347/86 |
| 2005/0185034 | A1 | 8/2005 | Anma et al. | 347/86 |
| 2005/0219303 | A1 | 10/2005 | Matsumoto et al. | 347/19 |

FOREIGN PATENT DOCUMENTS

| | | |
|---|---|---|
| DE | 202007007069 | 8/2007 |
| DE | 102008009460 | 8/2009 |
| EP | 854044 | 12/1998 |
| EP | 1122078 | 4/2001 |
| EP | 1352748 | 10/2003 |
| JP | 2-178050 | 7/1990 |
| JP | 3-067657 | 3/1991 |
| JP | 6-238913 | 8/1994 |
| JP | 8-058107 | 3/1996 |
| JP | 8-230206 | 9/1996 |
| JP | 11-348308 | 12/1999 |
| JP | 2001-253087 | 9/2001 |
| JP | 2002-307711 | 10/2002 |
| JP | 2003-103796 | 4/2003 |
| JP | 2003-156983 | 5/2003 |
| JP | 2003-300358 | 10/2003 |
| JP | 2003-334964 | 11/2003 |
| KR | 10-2005-67054 | 6/2005 |
| KR | 10-2006-91275 | 8/2006 |
| RU | 2170675 | 7/2001 |
| RU | 2178741 | 1/2002 |
| WO | 01/54912 | 8/2001 |
| WO | 2009/101097 | 8/2009 |

OTHER PUBLICATIONS

European Search Report, dated Oct. 26, 2006, in European counterpart Application No. 04030457.8.

European Extended Search Report, dated Oct. 26, 2006, in European counterpart 06116584.1.

Singapore Search and Examination Report (conducted by Austrian Patent Office on behalf of Singapore), dated Dec. 1, 2006, in Singapore counterpart 200407933-1.

Chinese Notification of Second Office Action, dated Jan. 26, 2007, in Chinese counterpart 200410103425.1, with English translation.

European Office Action dated Jan. 25, 2007, in European counterpart 04030457.8.

Canadian Office Action dated Jan. 24, 2007, in Canadian counterpart 2,490,741.

Korean Office Action dated Apr. 18, 2007, in Korean counterpart 10-2004-0111804.

Korean Office Action dated Sep. 5, 2007 in Korean counterpart 10-2006-0066119.

Korean Office Action dated Sep. 5, 2007, in Korean counterpart 10-2004-0111804.

Japanese Office Action dated Sep. 11, 2007, in counterpart 2003-435940, with excerpted English translation.

Korean Notice of Allowance dated May 29, 2008 in Korean counterpart 10-2006-0066119, with English language translation of allowed claims.

Korean Notice of Allowance dated May 29, 2008, in Korean counterpart 10-2004-0111804.

Singapore Search Report (Conducted by Danish Patent Office on behalf of Singapore) dated Sep. 23, 2009, in Singapore counterpart 200704789-7.

Russian Office Action dated Nov. 17, 2010, from corresponding Russian Application No. 2006123278/12(025260), and English language translation.

European Office Action dated Dec. 3, 2010, from corresponding European Application No. 10186009.6.

Indian Office Action dated Mar. 21, 2013 in Indian counterpart Application No. 1967/CHE/2008.

* cited by examiner

LIQUID CONTAINER

CROSS REFERENCE TO RELATED APPLICATIONS

This application is a division of application Ser. No. 13/543,716 filed Jul. 6, 2012, now U.S. Pat. No. 8,764,171 issued Jul. 1, 2014, which was a division of application Ser. No. 12/721,425 filed Mar. 10, 2010, now U.S. Pat. No. 8,376,535 issued Feb. 19, 2013, which was a division of application Ser. No. 11/473,063 filed Jun. 23, 2006, now U.S. Pat. No. 7,717,541 issued May 18, 2010, which was a division of application Ser. No. 11/016,914 filed Dec. 21, 2004, now U.S. Pat. No. 7,278,721 issued Oct. 9, 2007; and claims benefit of priority from Japanese Patent Application No. 435940/2003 filed Dec. 26, 2003; all of which are hereby incorporated by reference.

FIELD OF THE INVENTION AND RELATED ART

The present invention relates to a liquid container, in particular, a liquid container in the form of an ink container removably mountable in an ink jet recording unit or an ink jet recording apparatus, which records on recording medium by ejecting ink.

An ink jet recording apparatus which forms an image on recording medium by depositing ink in the form of liquid with the use of an ink jet recording head is widely used as an outputting means for such an information processing apparatus as a copying machine, a facsimileing machine, an electronic typewriter, a printer as an outputting peripheral device for a wordprocessor, a workstation, a personal or host computer, etc., or a portable printer to be connected to an optical disc apparatus, a video apparatus, a digital camera, etc.

As a system for supplying such an ink jet recording apparatus as those described above with ink, there is a system in which an ink container is inseparably or removably attached to a recording head mounted on a carriage or the like and reciprocally movable (in primary scanning direction), and ink is directly supplied to the recording head from this ink container. Whether an ink jet recording apparatus is structured so that an ink container is inseparably attached to a recording head, or it is structured so that an ink container is removably attached to a recording head, the positioning of an ink container relative to a recording head, or positioning of a recording head unit, that is, the integral combination of a recording head and an ink container, relative to a relevant member (for example, carriage of serial type recording apparatus, reciprocally movable in primary scanning direction) of the main assembly of a recording apparatus, is one of the most important issues related to recording quality. Further, it is very important, in particular, in the field of an ink jet recording apparatus for personal usage, to provide an ink supplying system for an ink jet recording apparatus which is small in size, simple in terms of the operation for mounting or dismounting an ink container or an ink jet recording head unit, and also, simple in terms of mechanism.

Thus, the inventors of the present invention have proposed a combination of an ink container and a structure for removably attaching an ink container, as an answer to the above described concerns. According to this proposal, an ink container is provided with a anchoring claw, which projects from one of the end surfaces, and a springy latching lever with an anchoring claw, which projects from the bottom portion of the opposite surface from the surface with the anchoring claw. Further, the holder to which an ink container is attached is provided with an anchoring hole into which the anchoring claw of an ink container fits, and an anchoring hole into which the anchoring claw of the springy latching lever of an ink container fits. The two anchoring holes of the holder are in the opposing two side walls of the holder, one for one. As for the mounting of the ink container, first, the ink container is to be positioned so that the anchoring claw projecting from one end of the ink container fits into the anchoring hole of the holder, and then, the ink container is to be pushed down into the predetermined position in the holder by the other end to cause the anchoring of the latching lever of the ink container to snap into the anchoring hole of the holder. With the two claws locked in the corresponding anchoring holes, the ink container is prevented from dislodging from the abovementioned predetermined position in the holder.

Such a removably mountable ink container as the one described above has been known to be provided with a storage means capable of electrically storing the information regarding the ink container itself (for example, color of ink therein), in order to make it possible to control the recording process of an ink jet recording apparatus, based on the information stored in the storage means. The information stored in the storage means is read as the ink container is mounted into the ink jet recording apparatus. In the case of an ink jet recording apparatus structured as described above, the ink container must be connected to the recording head so that not only is an ink passage established between the ink container and recording head, but also, an information exchange channel must be established between the two.

As one of the means for accomplishing the above described objects, Japanese Laid-open Patent Application 2001-253087 discloses the following structural arrangement: The electrical contacts of an ink container and the electrical contacts of a holder are disposed on the same side so that as the ink container is mounted into the holder, the electrical contacts of both sides come into contact with each other, and also, so that once they are placed in contact with each other, they are kept in contact with each other by the engagements between the anchoring claw, such as the one described above, of the ink container, with the corresponding anchoring hole of the holder, and between the anchoring claw of the latching lever, such as the above described one, of the ink container, and the corresponding anchoring hole of the holder. In the case of this structural arrangement, the electrical contacts of the two sides are automatically connected as the ink container is mounted into the holder, eliminating the need for a mechanism dedicated to the connection, or the need for performing a procedure dedicated for the connection. Therefore, this structural arrangement is advantageous from the standpoint of operational efficiency.

In comparison, the structural arrangement disclosed in Japanese Laid-open Patent Application 2001-253087 suffers from the following problems. That is, if the latching lever of the ink container and the electrical contacts of the holder are not equal in resiliency, for example, if the contact pressure of the electrical contacts is greater than the force generated by the resiliency of the latching lever, the latching lever is excessively deformed, failing thereby to keep the ink container in the predetermined position in terms of the direction in which the force generated by the latching lever acts on the ink container. Therefore, it is possible that the ink passage on the ink container side and the ink passage on the recording head side become misaligned at the joint, preventing thereby ink from being properly supplied, and/or allowing ink to leak from the joint. It is also possible that the contact pressure between the electrical contacts on the ink container side and holder side will become unstable, failing thereby to remain properly connected in terms of electrical conduction.

As the solution to the above described problems, it is possible to place the electrical contact portion on the bottom surface of the ink container in the same manner as the one disclosed in Japanese Laid-open Patent Application 2-178050. According to Japanese Laid-open Patent Application 2-178050, the ink jet recording head is integral with an ink container, and is removably mountable in the carriage of the ink jet recording apparatus. Its electrical contacts through which recording signals are transmitted to the recording head from the main assembly of the recording apparatus are attached to the bottom surface of the recording head, and the corresponding surface of the carriage. Thus, as the recording head is mounted into the carriage, the electrical contacts of the recording head come into contact with the electrical contact of the carriage, and then, keep sliding thereon while the recording head is moved (pivotally) into its final position on the carriage. Therefore, the electrical contacts of the recording head and the electrical contacts of the carriage are better connected in terms of electrical conductivity. Thus, it seems reasonable to the adopt the design of the electrical joint between the recording head and carriage disclosed in Japanese Laid-open Patent Application 2-178050 to the design of the electrical joint between an ink container and a recording head, through which the ink container information is electrically transmitted.

However, electrical contacts are electrically conductive members formed of relatively rigid metallic substance, and therefore, applying a large amount of pressure to electrical contacts, and/or causing electrical contacts to slide on each other while applying a large amount of pressure, in order to ensure that the electrical contacts of an ink container and the electrical contacts of the main assembly remain satisfactorily connected in terms of electrical conductivity is unwise from the standpoint of the prevention of the damage to the electrical contacts and the durability of the electrical contacts. In other words, the amount of the pressure to be applied to the electrical contacts to ensure that the electrical contacts of the ink container are kept satisfactorily connected to the electrical contacts of the main assembly must be optimum, that is, the minimum to be effective. Thus, it is unwise to adopt the technologies disclosed in Japanese Laid-open Patent Application 2-178050 without any modification. In particular, in the case that an ink container is removably attachable to a recording head, there is the possibility that when an ink container is attached or removed, the tip of the ink outlet of the ink container will come into contact with the electrical contacts of the main assembly, and wets them. Further, should ink leak from the joint between the ink outlet of the ink container and the ink inlet of the main assembly during the mounting of the ink container, it is very likely that the ink having leaked from the joint will reach the electrical contacts, because the electrical contacts are attached to the bottom surface of the ink container.

SUMMARY OF THE INVENTION

Thus, the primary object of the present invention is to improve a liquid container having a liquid outlet and an information storage means of a contact type, in order to make it easier to mount or dismount, simpler in the structure of the mechanism for mounting it, more reliable and accurate in terms of its position relative to a device to which it is connected, smaller in the amount of force necessary to mount it, and also, more reliable in terms of the connection between its liquid outlet and the liquid inlet of a device to which it is connected, and the electrical connection between its information storage means and the information storage means of the device to which it is connected.

Another object of the present invention is to provide a structural arrangement for a liquid container, which is superior, in terms of leak prevention, to the structural arrangement for a liquid container in accordance with the prior art.

According to an aspect of the present invention, there is provided a liquid container detachably mountable to a mounting portion of an apparatus, the mounting portion including a first locking portion and a second locking portion, said liquid container including a casing for containing liquid and a supply port for supplying the liquid to an ink jet head, said liquid container comprising a first engaging portion provided at a first side of said casing and engageable with the first locking portion; a second engaging portion provided opposed to a second side of said casing which is opposite said first side, said second engaging portion being engageable with the second locking portion; a supporting member for displaceably supporting said second engaging portion; a contact contactable to a member provided in the mounting portion to permit information display means to display information relating to said liquid container, wherein said supply port is disposed in a third side of said casing which is between said first side and said second side, and said contact is disposed at a corner region between said second side and said third side.

A liquid container structured described above is mounted, in the following manner, into a predetermined liquid container mount of a device to which the liquid container is to be attached: First, a liquid container anchoring first portion on the external surface of one of the lateral walls of the liquid container is to be engaged with a liquid container anchoring first portion of the liquid container mount, and the liquid container is to be pressed by its opposite wall from the wall having the liquid outlet. As the liquid container is pressed, the liquid container moves into the liquid container mount while rotating about the liquid container anchoring first portion. It is ensured by the resiliency of the latching lever of the liquid container that the liquid container is accurately positioned relative to the liquid container mount and retained there. Providing the latching lever of the liquid container with a liquid container anchoring second portion engageable with the liquid container anchoring portion of the liquid container mount further ensures that the liquid container is accurately positioned relative to the liquid container mount, and makes it easier to mount the liquid container.

Further, since the liquid container is accurately and reliably positioned relative to the liquid container holder (mount), and the liquid outlet of the liquid container is positioned between the lateral wall of the liquid container, on the external surface of which the liquid container anchoring portion, which serves as the above described rotational center, is located, and the opposite lateral wall of the ink container, the possibility of liquid leakage is minimized by the synergetic coordination of the force generated by the contact pressure between the liquid outlet of the liquid container and the liquid inlet of the liquid container mount side, and the force generated by the resiliency of the latching lever of the liquid container.

In addition, the electrical contacts of the information storage means are disposed on the corner portion, or the edge, between the lateral wall of the liquid container having the liquid outlet and the lateral wall of the liquid container upon which the force generated by the resiliency of the latching lever acts. Therefore, the electrical contacts of the information storage means come into contact with the electrical contacts on the liquid container holder side immediately before the process for mounting the liquid container in the rotational movement is completed. In other words, the electrical contacts of the liquid container and the electrical contacts of the liquid container holder side are placed in contact with each other by the same action taken to couple the liquid outlet of the liquid container with the ink inlet of the liquid container holder. Therefore, not only are the electrical contacts on both sides are placed in contact with each other in the preferable condition, but also, the amount of force required to mount the liquid container is substantially smaller compared to that required when the liquid container in accordance with the prior art is mounted. Further, the latching lever (supporting member) is structured so that its surface facing the wall of the liquid container holder is tilted in such a manner that the closer a given point of the surface is to the wall of the liquid container having the liquid outlet, the closer the given point of the surface is to the wall of the liquid container having the latching lever, and the liquid container and the liquid container holder are structured so that as the liquid container is mounted into the liquid container holder, the rotational movement of the liquid container about the liquid container anchoring first portion can be utilized as the lever action, in which the liquid outlet is the point of action. Therefore, if the liquid container is released before the liquid container anchoring second portion of the latching lever completely engages with the liquid container anchoring second portion of the liquid container mount (holder), the liquid container is popped upward by the reaction force, informing therefore an operator of the incompletion of the liquid container mounting process, ensuring thereby that the liquid container is completely mounted. Further, the information storage means is disposed on the aforementioned slanted wall, that is, the corner portion, of the liquid container. Therefore, as the liquid container is mounted into the liquid container mount (holder), the information storage means is positioned at a level which is a step higher than the bottom wall, that is, the wall having the liquid outlet, of the liquid container. Therefore, even if liquid leaks through the liquid outlet, the information storage means would be protected from the effects of the leak.

As described above, the present invention makes it possible to make a liquid container, which has a liquid outlet and an information storage means having electrical contacts, simpler in the mechanism for mounting it into the liquid container mount of a device to which it is attached, simpler in the procedure for mounting it, more reliable and accurate in positioning, smaller in the amount of force necessary to mount it, and better in the state of connection between its liquid outlet and the liquid inlet of a device to which it is attached and the state of contact between the electrical contacts of its information storage means and the electrical contacts of the device to which it is attached.

Further, the present invention can structure a combination of a liquid container and the liquid container mount of a device to which the liquid container is to be attached, so that its electrical contacts are protected from the liquid leakage from the liquid container.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter the preferred embodiments of the present invention will be described with reference to the appended drawings.

In this specification, not only does recording mean a process for forming various kinds of images, whether the images have a meaning or not, or whether or not the images are visible, that is, whether or not the images can be detected by the human eye. In other words, it means the process for forming various kinds of images, including the process of treating recording medium itself.

The meaning of "recording medium" is not limited to the paper used by an ordinary recording apparatus. That is, it includes a much wider range of medium, for example, fabric, plastic, film, metallic plate, glass, ceramic, lumber, leather, etc. In other words, it means anything on which an image can be formed with the use of ink. Hereafter, "recording medium" may sometimes be referred to as "paper".

Further, "ink" or "liquid" should be as widely interpreted as the above described meaning of recording. They include any liquid which can form images, that is, meaningful and meaningless patterns, can treat recording mediums, and/or can treat ink itself or recording medium (for example, improve images in terms of fixation, quality, color development, durability, etc., by solidifying coloring ingredient of ink deposited onto recording medium).

1. First Embodiment

1-1 Ink Container

Figure 1:
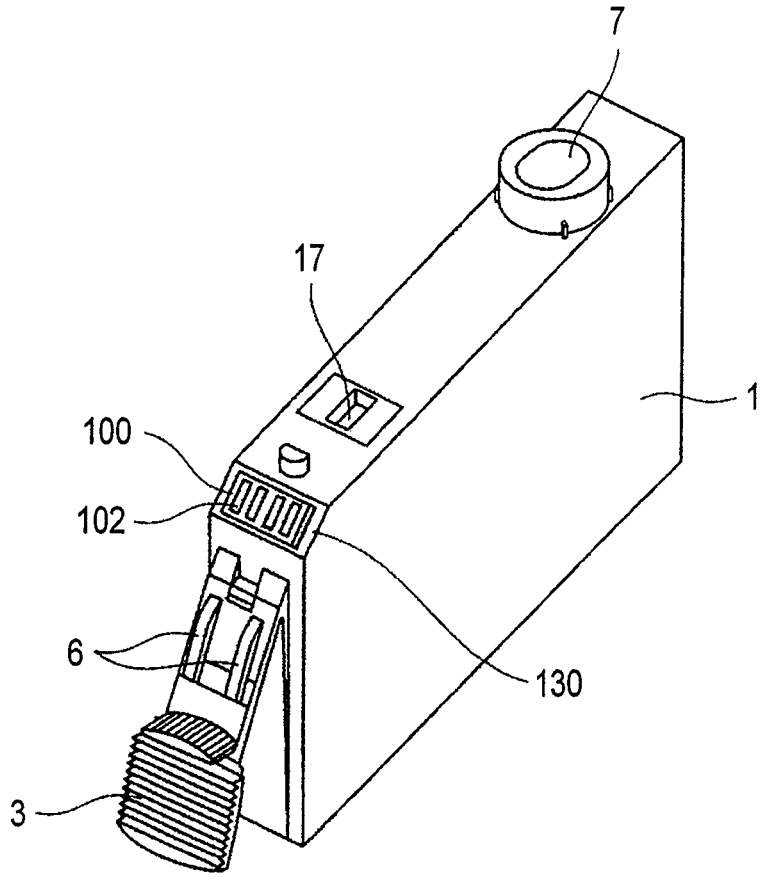
FIG. 1 is a perspective view of the ink container in the first embodiment of the present invention, as seen from the bottom side.
Figure 2:
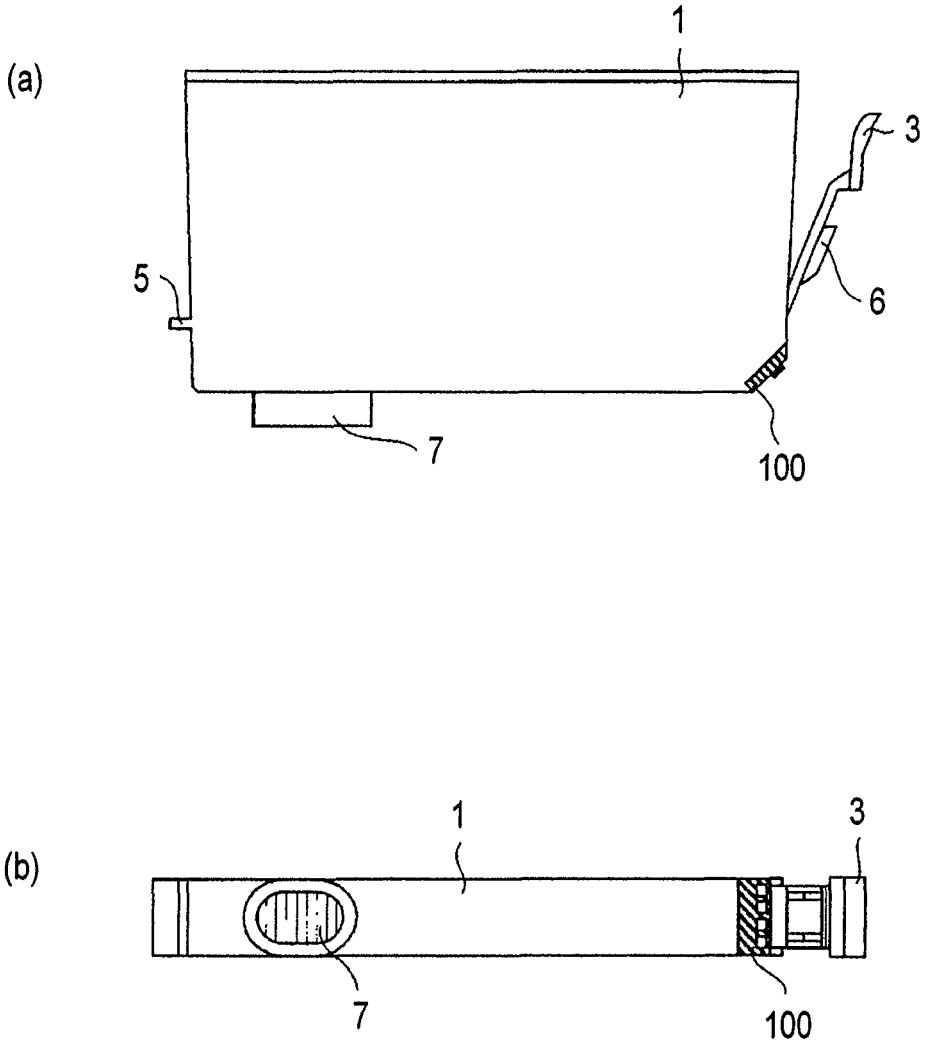
FIGS. 2(*a*) and 2(*b*) are side and bottom plan views, respectively, of the ink container shown in FIG. 1.
Figure 3:
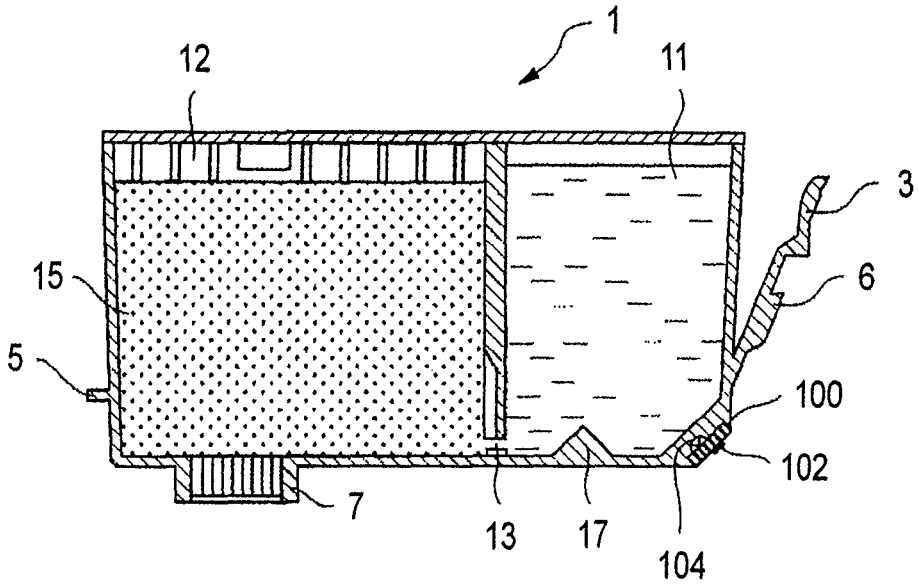
FIG. 3 is a schematic sectional view of the ink container shown in FIG. 1, at plane parallel to the side walls of the container.

FIG. 1 is a perspective view of the ink container in the first embodiment as seen from the bottom side, and FIGS. 2(*a*) and 2(*b*) are side and bottom plan views of the ink container in the first embodiment. FIG. 3 is a sectional view of the ink container, at a plane parallel to the side walls of the ink container. It should be noted here that in the following description of the preferred embodiments of the present invention, the front surface of an ink container means the surface which a user faces to operate the apparatus (to mount or dismount ink container, or the like operation).

The ink container 1 in this embodiment has a supporting member (latching lever) 3 attached to the bottom of the front surface. The latching lever 3 is an integral part of the ink container 1, and is formed of resin. It is formed with the container proper of the ink container 1. It is structured so that it can be elastically deformed toward the container proper of the ink container 1 as the ink container 1 is mounted into the ink container mount (which hereinafter may sometimes be referred to as holder) of a recording apparatus, or as the like operation is carried out. The ink container mount of a recording apparatus will be described later. The ink container 1 also has first and second projections 5 and 6, which engage with the counterparts of the ink container holder. The first and second projections 5 and 6 are located on the back and front sides, respectively, of the ink container 1. In this embodiment, the second projection 6 is an integral part of the latching lever 3. The ink container 1 is securely anchored to the ink container holder by the engagement between the projections 5 and 6 of the ink container 1 and their counterparts of the ink container holder. The procedure for mounting the ink container 1 into the ink container holder will be described later referring to FIG. 4.

The bottom wall of the ink container 1 is provided with an ink outlet 7 through which ink is released. The ink outlet 7 couples with the ink inlet of a recording head as the ink container 1 is mounted into the ink container holder. The recording head will be described later. The corner portion of the ink container 1 where the front and bottom walls of the container 1 meet is shaped as if it were chamfered; the front and bottom walls are connected with a slanted wall 130, the angle of which is roughly 45°. The angle of this slanted wall is roughly the same as the angle at which the latching lever 3 extends from the bottom of the front surface. To this slanted wall 130, an information storage medium 104 and a circuit board 100 are attached. The information storage medium 104 stores the information about the ink container itself. The circuit board 100 has multiple contact pads 102 as electrical contacts electrically connectable to the connector of the holder. In the case of the ink container shown in FIG. 3, the information storage medium 104 was sealed with protective sealant after it was attached to the circuit board 100.

Referring to FIGS. 2 and 3, the external surface of the slanted wall 130 of the ink container 1, to which contact pad 102 is attached, is one of the surfaces of the ink container 1 which are not suitable as the surface on which the ink container 1 is rested. In other words, the contact pad 102 is attached to the surface of the ink container 1, which is not suitable as the surface on which the ink container 1 is rested. Therefore, attaching the contact pad 102 to the external surface of the slanted wall 130 is expedient from the standpoint of preventing such a problem as an accidental damage to the contact pad 102. In addition, providing the ink container 1 with this slanted wall 130 gives the bottom wall of the ink chamber 11 a slanted portion, which will conceivably impel the ink toward the ink outlet 13, contributing to the minimization of the amount of the ink which fail to be drawn out of the ink chamber 11.

In this embodiment, the angle of the slanted wall 130 is 45°. In the case that the ink container 1 is structured so that the ink outlet 7 thereof protrudes outward as shown in FIG. 3, the slanted wall 130 does not come into contact with the surface of a desk or the like on which the ink container 1 might be placed, whether the ink container 1 is placed on the desk or the like so that the wall having the ink outlet faces downward, or the latching lever 3 faces downward (obviously, this is only hypothetical because it is impossible to place the ink container in this manner because of presence of latching lever 3). Further, as will be described later in detail, an angle of 45° is the best angle in that the vertical and horizontal components of the contact pressure between the contact pad 102 and the connector 152 of the holder 150 best balance with each other. The angle of the slanted wall 130 may be varied within a range in which the above described effect can be expected. However, in consideration of practicality, the amount of the deviation is desired to be within ~5°.

As the ink container 1 is mounted into the ink jet recording apparatus, it becomes possible for the contents (for example, expiration date of ink, amount of ink in container, ink color, etc., usable for controlling various aspects of image forming process related to ink container) of the information storage medium 104 to be transmitted to the ink jet recording apparatus. This information can be used by the ink jet recording apparatus for various purposes. For example, the information regarding the expiration date of the ink container 1 can be used to suggest that a user replace the ink container 1 in order to prevent the recording failure attributable to the discoloration of the ink, and increase in the viscosity of the ink. The information regarding the remaining amount of the ink can be used for informing a user of the insufficiency of the amount of the ink in the ink container, in order to prevent the user from suffering from the inconvenience of the interruption of a recording operation (ink ejection) attributable to ink depletion, during recording. Further, the information regarding the color of the ink in the ink container 1 can be used for preventing unsatisfactory recording by informing a user of the mounting of an ink container containing ink different in color from the intended one. In other words, with such information as the above described in the information storage means being available to the recording apparatus, it is possible to always obtain a high quality recording.

As the information storage medium 104, various means can be used, for example, a magnetic medium, an photomagnetic medium, an electrical storage medium, a mechanical switch as a DIP switch, etc., in other words, any means capable of storing information that can be exchanged between itself and an ink jet recording apparatus by being placed in contact with the contact portion of the ink jet recording apparatus. Further, it may be a flush memory, or an instantly writable magnetic medium. However, when it is desired that not only is the information storage medium 104 capable of providing the recording apparatus with the information, but also, the information from the recording apparatus (for example, the amount of ink remainder, ink usage, etc., estimated based on image formation data) can be written into the information medium 104, or the information therein can be modified or erased, it is possible to employ an EEPROM (electrically erasable programmable ROM).

Referring to FIG. 3, the internal space of the ink container 1 is divided into the ink storage chambers 11 and 12. The ink storage chamber 11 is on the front side where the cartridge anchoring latching lever 3 and circuit board 100 are located, whereas the ink storage chamber 12 is on the back side, and has the ink outlet 7. The two ink storage chambers 11 and 12 are connected through a hole 13. The ink storage chamber 11 is an empty space in which nothing but ink is stored. However, the ink storage chamber 12 is completely filled with an ink absorbent member 15 formed of sponge or the like, or completely packed with fine fiber, or the like, and ink is stored in the ink storage chamber 12 by being absorbed into the ink absorbent member 15. The ink absorbent member 15 is for generating negative pressure by the amount in the range in which the negative pressure is large enough to prevent ink from leaking from the ink ejecting portion, in coordination with the ink retaining force of the meniscuses formed in the ink ejection nozzles of the recording head, and yet, small enough to allow the recording head to eject ink.

The structure of the ink container 1 does not need to be limited to the above described one in which the internal space of the ink container 1 is divided into the ink storage chamber completely filled with the ink absorbent member, and the ink storage chamber which is nothing but an empty space. For example, it may be such that virtually the entirety of the internal space of the ink container 1 is completely filled up with the ink absorbent member. Further, instead of employing an ink absorbent member as a negative pressure generating means, ink may be directly filled into a pouch, which is formed of elastic substance such as rubber, the resiliency of which acts in the direction to stretch the pouch wall so that its internal space increases. In such a case, the negative force is generated by the tensile force of the pouch. Further, the ink container 1 may be in the form of an ink pouch, a part of the wall of which is formed of elastic material, and which is directly filled with ink. In this case, the negative pressure is generated by the resiliency of the elastic wall portion of the ink container. Further, the ink container 1 may be a combination of a container proper and a pressure adjustment mechanism (for example, one-way valve which opens as internal pressure of container proper falls below predetermined level). In this case, ink is directly stored in the entirety of the internal space of the container proper, and the internal pressure of the container proper is maintained at a predetermined level by the pressure adjustment mechanism.

Referring to FIGS. 1 and 3, the bottom wall of the ink chamber 11 is provided with an ink level detecting portion 17, which is positioned so that it opposes the ink remainder detection sensor (which will be described later) of the main assembly of the recording apparatus when the ink container 1 is in the main assembly. In this embodiment, the ink remainder amount detection sensor is an optical sensor made up of a combination of a light emitting portion and a light receiving portion. The ink remainder amount detection portion 17 is formed of transparent or semitransparent material. More specifically, it is in the form of a prism, the shape and apex angles, etc., of which are predetermined so that when no ink is in the ink storage chamber 11, the beam of light emitted from the light emitting portion is accurately reflected to the light receiving portion (which will also be described later).

1-2 Ink Container Mount (Holder)

Figure 4:
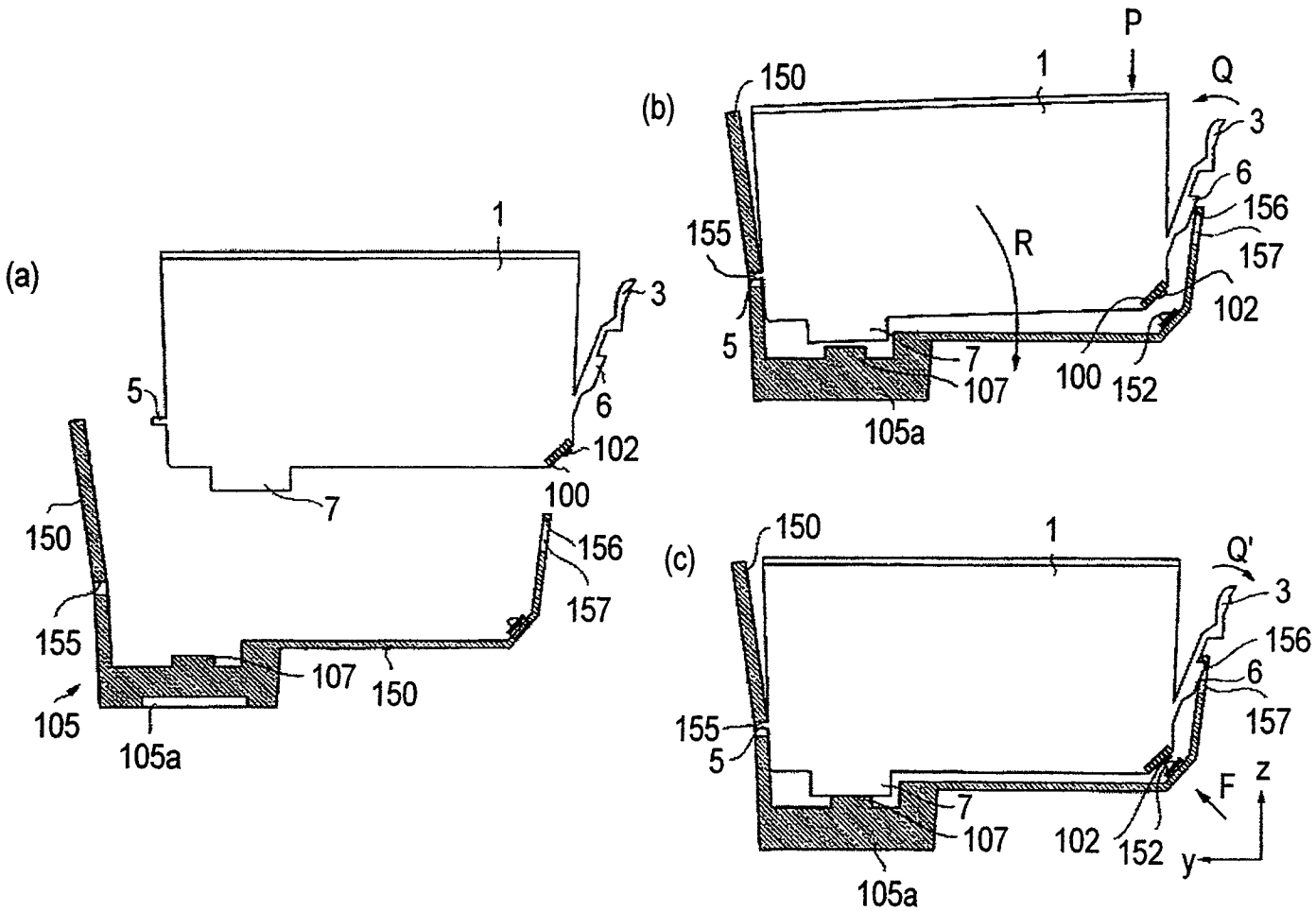
FIGS. 4(*a*) to (*c*) are schematic drawings for showing the structure of the ink container mount (holder) of the main assembly of an ink jet recording apparatus, and the procedure for mounting the ink container into the ink container mount (holder).

FIGS. 4(*a*)-(*c*) are schematic drawings for depicting the ink container mount (holder) of the recording head unit, into which the ink container is mounted, and the procedure for mounting the ink container into the mount (holder).

Generally, the recording head unit 105 is made up of the holder 150 which removably holds ink containers, and a recording head 105*a* located under the bottom wall of the holder 150. As the ink container 1 is inserted into the holder 150, the ink container anchoring first and second projections 5 and 6 of the ink container 1 engage with the ink container anchoring portions 155 and 156, respectively, of the holder 150 which is an integral part of the recording head unit 105 comprising the recording head 105*a*. As a result, the ink container 1 is firmly anchored to the holder 150. At the same time, the ink inlet 107 of the recording head, which is located at the bottom of the holder 150, couples with the ink outlet 7 of the ink container 1, creating thereby an ink passage between the recording head 105*a* and ink container 1. Also during the insertion of the ink container 1 into the holder 150, the connector 152 of the holder 150 comes into contact with the contact pad 102 on the outwardly facing surface of the circuit board 100, establishing electrical connection between the holder 150 and ink container 1.

Next, the process through which the ink container 1 is precisely positioned relative to the holder 150 as the ink container 1 is mounted into the holder 150 will be described. When mounting the ink container 1 into the recording head unit 105, the ink container 1 is to be inserted into the ink container compartment of the holder 150 from above (FIG. 4(*a*)) so that the ink container anchoring first projection 5 on the back surface of the ink container 1 will be inserted into the ink container anchoring first portion 155, in the form a through hole, on the back wall of the holder 150, and also, so that the ink container anchoring projection 6 of the latching lever 3 rests on the top edge of the front wall of the holder 150 (FIG. 4(*b*)).

Then, the ink container 1 is to be pressed down by the top front end of the ink container 1 in the direction indicated by an arrow mark P. As the ink container is pressed, the ink container 1 rotates in the direction indicated by an arrow mark R, with the contact point between the ink container anchoring first projection 5 of the ink container 1 and the ink container anchoring first portion 155 of the holder 150 serving as the center of rotation. As a result, the front side of the ink container 1 moves downward faster than the back side of the ink container 1. While the ink container 1 is downwardly moving as described above, the latching lever 3 on the front side of the ink container 1, is elastically deformed in the direction indicated by an arrow mark Q, because the front surface of the ink container anchoring second projection 6 of the latching lever 3 of the ink container 1 remaining in contact with the top front edge of the front wall of the holder 150, being therefore pressed by the reaction force generated as the ink container 1 is pressed.

Then, as the top edge of the ink container anchoring second projection 6 of the ink container 1 is moved past the top edge of the front wall of the holder 150, and brought to the hole 157 located below the top edge of the front wall of the holder 150, the latching lever 3 elastically deforms in the direction indicated by a arrow mark Q' due to its own resiliency, snapping into the hole 157. As a result, the projection 6 becomes locked with the top edge of the hole 157 (top edge of hole 157 constitutes ink container anchoring second portion 156). Obviously, the ink container anchoring second portion 156 may be the top edge of the hole of the front wall of the holder 150 as it is in this embodiment, or the front wall of the holder 150 may be provided with a small rib or projection capable of anchoring the projection 6 of the ink container 1. When the ink container 1 is in the state shown in FIG. 4(*c*), the ink container 1 is kept pressured in the horizontal direction (direction indicated by an arrow mark y) by the ink container anchoring second portion 156, more specifically, the resiliency of the latching lever 3 sandwiched between the container proper of the ink container 1 and the font wall of the holder 150. As a result, the back wall of the ink container 1 is kept in contact with the back wall of the holder 150. As for the angles of the back walls of the ink container 1 and holder 150, the walls have only to be intersectional to the direction in which the ink container 1 is kept pressured by the latching lever 3. However, from the standpoint of the level of preciseness with which the ink container 1 is positioned relative to the holder 150, the walls are desired to be perpendicular to the direction in which the ink container 1 is kept pressured by the latching lever 3. Further, as the ink outlet 7 of the ink container 1 couples with the ink inlet 107 of the recording head 105*a*, the elastic ink absorbent member in the ink outlet 7 comes into contact with the ink inlet of the recording head 105*a*, being thereby compressed. As a result, the ink container 1 is subjected to the pressure generated by the absorbent member in the ink outlet 7 in the direction indicated by an arrow mark z in FIG. 4(*c*), that is, the upward pressure. However, this upward pressure generated by the ink absorbent member is negated by the ink container anchoring first portion 155 in engagement with the ink container anchoring first portion 5, and the ink container anchoring second portion 156 in engagement with the ink container anchoring second projection 6. In other words, the state of the ink container 1 shown in FIG. 4(*c*) is the state of the ink container 1 at the completion of the mounting of the ink container 1 into the recording head unit 105. In this state, the ink outlet 7 and ink inlet 107 are in contact with each other, and so are the pad 102 and connector 152. As described above, during the mounting of the ink container 1, the above described reactive force acts on the ink container. Therefore, if the ink container 1 is released before the ink container anchoring second portion 6 of the latching lever 3 engages with the ink container anchoring second portion 156, in other words, before the mounting of the ink container 1 is completed, the ink container 1 will pop up from the holder 150 because of the pressure generated by the ink absorbent member in the direction indicated by the arrow mark z, that is, the direction to push the ink container 1 upward, informing an operator of the incomplete mounting of the ink container 1, and therefore, ensuring that the ink container 1 is satisfactorily mounted. In addition, the fact that the surface of the ink container anchoring portion 6, which remains in contact with the top edge of the back wall of the holder 150, is tilted so that the closer to the bottom wall of the ink container 1, that is, the wall having the ink outlet 7, a given point of the surface is, the closer to the container proper the given point of the surface is, also contributes more or less to the upward force which causes the ink container 1 to pop up if the ink container 1 is released before the completion of the mounting of the ink container 1.

Also when the ink container 1 is in the state shown in FIG. 4(*c*), the ink remainder detection portion 17, in the form of a prism, of the bottom wall of the ink container 1 opposes the ink remainder amount detection sensor of the main assembly (holder 150) of the recording apparatus. Thus, it is possible for the beam of the light emitted from the light emitting portion to enter the ink remainder detecting portion 17 in the form of a prism, be reflected (deflected) by the first surface of the portion 17, be reflected (deflected) by the second surface of the portion 17, and then, enter the light receiving portion of the sensor.

To describe the movement of the ink container 1, shown in FIG. 4(*c*), which occurs during the mounting of the ink container 1 into the recording head unit 105, compared to the principle of action of a lever, the contact point between the ink container anchoring first portion 5 of the ink container 1 and the ink container anchoring first portion of the holder 150 constitutes the fulcrum, and the point of the front side of the ink container 1, by which the ink container 1 is pressed by an operator constitutes the force application point. Further, the contact point (area) between the ink outlet 7 and ink inlet 107 constitutes the point of action, which is located between the point of force application and fulcrum, preferably being near the fulcrum so that as the ink container 1 is rotationally moved into the holder 150, the ink outlet 7 is pressed onto the ink inlet 107 by a substantial amount of force. Generally, the joint portion (opening) of the ink outlet 107 is fitted with a combination of a filter and a relatively flexible and elastic member, such as a piece of absorbent material, a seal, or the like, in order to ensure that ink is allowed to flow from the ink container 1 to the recording head 105*a*, and that ink does not leak from the joint between the ink container 1 and recording head 105*a*.

In view of the purpose of mounting the ink container 1 into the recording head unit 105 (holder 150), it is desirable to employ such a structural arrangement and an ink container mounting process as those described above for applying a relatively large amount of force in order to elastically deform the portions of the ink container 1 relevant to the formation of the ink passage between the ink container 1 and recording head 105*a*, and the prevention of ink leakage from the joint between the ink outlet 7 and ink inlet 107. Further, after the completion of the mounting of the ink container 1 into the recording head unit 105, the ink container 1 is prevented from becoming loose from the holder 150, by the ink container anchoring first portion 5 having engaged with the ink container anchoring first portion 155, and the ink container anchoring second portion 6 having engaged with the ink container anchoring second portion 156. Therefore, the aforementioned elastic members remain properly compressed (elastically deformed); for example, the absorbent member in the ink outlet 7 remains optimally compressed by the ink inlet 107 (combination of filter and tip of ink outlet, if tip of ink inlet 107 is fitted with filter), or the sealing member fitted around the tip of the ink inlet 107 remains optimally compressed by the ink outlet 17 (if the tip of the ink inlet 107 is fitted with the sealing member).

On one hand, the pad 102 and connector 152 are metallic members which are relatively high in rigidity, and highly conductive of electricity, and a high level of electrical conductivity must be established between them. On the other hand, applying an excessive amount of pressure to achieve such a level of conductivity is not desirable from the standpoint of damages and durability. Thus, in this embodiment, the pad 102 and connector 152 are placed as far away as possible from the fulcrum, that is, they are placed in the adjacencies of the front wall of the ink container 1, in order to optimize the contact pressure between them, that is, make the contact pressure as small as possible without jeopardizing the conductivity.

More specifically, the contact pad 102 is disposed on the external surface of the slanted wall 130 extending from the farthest point of the bottom wall of the ink container 1 from the ink container anchoring first portion 5. Therefore, when mounting the ink container 1 into the holder 150, the contact pad 102 comes into contact with the connector 152 right at the end of the process of mounting of the ink container 1 into the holder 150.

With the provision of the above described structural arrangement, the force generated by the contact pressure between the contact pad 102 and connector 152 in the direction of the ink container anchoring first portion 5 (direction of arrow mark y) is a component of the force F generated by the contact pressure between the contact pad 102 and connector 152 in the direction perpendicular to the slanted wall 130. In other words, the above described structural arrangement can minimize the problem, mentioned in the description of the Japanese Laid-open Patent Application 2001-253087, that is attributable to the relationship between the amount of the resiliency of the latching lever and the amount of the contact pressure between the contact pad 102 and connector 152; it virtually eliminates the problem, ensuring that the contact pad 102 and connector 152 are correctly connected to each other in terms of electrical conductivity.

In addition, according to the above described structural arrangement, the relationship between the positional relationship between the contact pad 102 and the ink container anchoring second portion 6 of the latching lever 3, and the positional relationship between the connector 152 of the holder 105 and the ink container anchoring second portion, is such that the contact pad 102 comes into contact with the connector 152 immediately before the completion of the process of mounting the ink container 1 into the holder 150, causing thereby the contact pressure between the contact pad 102 and connector 152 to be generated after the completion of the process (after completion of engagement between ink container anchoring second portion 6 and ink container anchoring second portion 106 of holder 150). Therefore, it is extremely unlikely that the ink container 1 will fail to be precisely positioned in the holder 150 as described above, and/or that ink fail to be satisfactorily supplied to the recording head due to the misalignment between the ink outlet 7 of the ink container 1 with the ink inlet 107 of the holder 107. In addition, the above described structural arrangement ensures that the ink container 1 is precisely positioned relative to the electrical contacts of the connector. Therefore, the contact pressure remains stable, eliminating the possibility that connective failure will occur in terms of electrical conductivity. Further, the above described structural arrangement prevents the ink remainder detecting portion 17 in the form of a prism from deviating in position. Therefore, the possibility is extremely small that the ink remainder amount will not be detected at all or will be incorrectly detected due to the misalignment between the light path and light receiving portion of the ink remainder detecting portion 17.

Further, the above described structural arrangement in accordance with the present invention can solve the problems that occur when the structural arrangement disclosed in Japanese Laid-open Patent Application 2-178050 is employed without modifications, that is, the problem that occurs as the information storage medium and/or contact pad is placed on the bottom surface of an ink container, in other words, the problems that during the mounting of an ink container, the ink outlet comes into contact with the connector; and/or that short circuit occurs because of the ink leakage from the ink outlet, or the like. The reason why the abovementioned problems are solved is all because the connector 152 in this embodiment is located at a level which is a step higher from the bottom wall of the holder 150.

Moreover, in the case that the information storage medium and/or compact pad is placed on the bottom surface of the ink container, even if they are positioned as far as possible from the first ink container anchoring portion, that is, in the immediate adjacencies of the front wall of the ink container, the electrical contacts of the ink container and the electrical contacts of the holder come into contact with each other, while squarely facing each other, immediately before the completion of the process of mounting the ink container. In this case, therefore, in order to ensure that the satisfactory electrical connection is established between the ink container and holder regardless of the surface conditions of the electrical contacts on both sides, the ink container must be mounted with the application of a substantial amount of pressure, and the application of a large amount of pressure may result in the application of an excessive amount of pressure on the electrical contacts.

In comparison, in the case of the structural arrangement in this embodiment, strictly in terms the balance between the amount of the reactive force (generated in vertical direction) applied to the pad 102 by the connector 152, at the contact point between the pad 102 and connector 152 as a certain amount of force is applied to the ink container 1 in order to move the ink container 1 vertically downward, and the amount of the force applied to the ink container 1, the reactive force to which the pad 102 is subjected is the component of the force generated (in the direction perpendicular to the slanted surface 130) by the contact pressure between the connector 152 and pad 102. Therefore, the amount by which the pressure being applied downward to the ink container 1 increases at the end of the process of mounting the ink container 1 when electrical connection is established between the electrical contacts of the circuit board and the electrical contacts of the holder, is small, and therefore, does not drastically reduce the efficiency with which the ink container 1 is mounted by a user.

Also, according to the structural arrangement in this embodiment, as the ink container 1 is pressed to be placed into the final position (in which ink container anchoring first and second portion 5 and 6 of ink container engage with ink container anchoring first and second portions 105 and 106, respectively, of holder 150), a component force (which causes pad 102 to slide on connector 152) is generated by the pressure applied to the ink container 1 in the direction parallel to the primary flat surface of the circuit board 100, ensuring that the process for mounting the ink container 1 ends as satisfactory electrical connection is established between the pad 102 and connector 152.

Also in the case of the structural arrangement in this embodiment, the contact pressure between the pad 102 and connector 152 does not occur until immediately before the completion of the mounting of the ink container, in other words, until the very end of the precise positioning of the ink container 1. Therefore, if the operation for mounting the ink container 1 is stopped before the ink container anchoring second projection 6 of the latching lever 3 reaches the hole 157 (ink container anchoring second portion) of the holder 150, the ink container 1 is popped up by the combination of the component force of the force generated by the resiliency of the latching lever 3, the slanted surface (of ink container anchoring second projection 6) of which is in contact with the top edge of the front wall of the holder 150, and the reactive force resulting from the pressing of the ink outlet 7 upon the ink inlet 107. Therefore, should the ink container 1 be incompletely mounted, a user will be informed that the ink container 1 has not been completely mounted.

As described above, according to this embodiment of the present invention, the ink container 1 is provided with the resilient member (latching lever), which keeps the ink container pressured toward the referential point (ink container anchoring first portion, or contact point between ink container anchoring first portion and corresponding portion of holder) on the back surface of the ink container, and the circuit board having the information storage medium, and/or contact pad, is positioned between the referential point and resilient member, in terms of the horizontal direction. Therefore, the ink container is more precisely positioned relative to the holder, ensuring that the connector and contact pad are precisely positioned relative to each other. Therefore, the electrical contacts of the ink container are reliably connected to the electrical contacts of the holder, in terms of electrical conductivity. This, in turn, makes it possible to minimize the size of the contact pad, making it thereby possible to reduce the size of the circuit board on which the information storage medium is mounted. In other words, it is quite reasonable to say that the structural arrangement in this embodiment is superior to that in accordance with the prior art, in consideration of various factors in the design of the ink container and the holder therefor, for example, the amount of force necessary to be applied to an ink container when mounting the ink container, operability of an ink container, reliability in the state of electrical contact, protection of electrical contacts from ink leak, etc.

Figure 17:
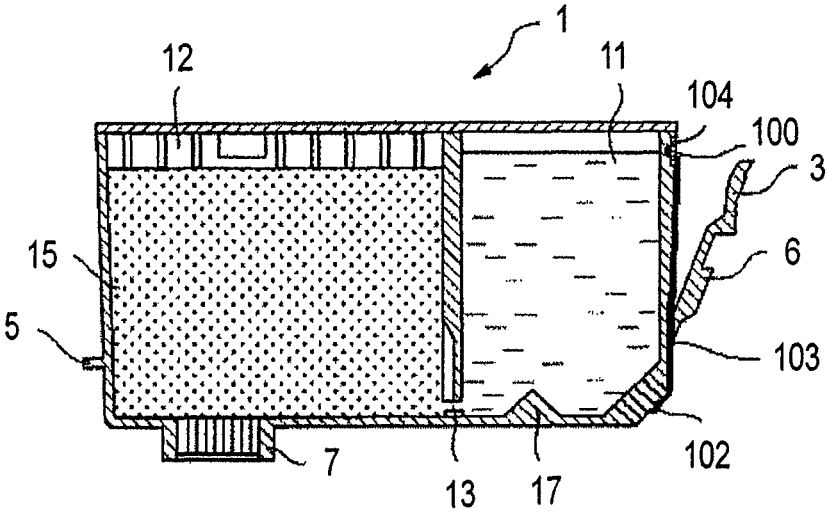
FIG. 17 is a sectional view of the ink container according to a further embodiment of the present invention.

FIG. 17 shows another embodiment. An aspect of the present invention is particularly directed to the position of the contact pad 102. In this embodiment of the present invention, the information storing medium 104 is disposed at another place, more particularly, at a top side, in use, or at a position facing the supporting member. In such a case, an electrode 103 or lead is extended from the information medium 104 to the contact pad 102 which is located at the position according to the aspect of the present invention.

1-3 Application of Present Invention to Ink Jet Recording Apparatus

Next, an example of a recording head, and also, an example of an ink jet recording apparatus, in which the ink container in the above described first embodiment is mountable, will be described.

Figure 5:
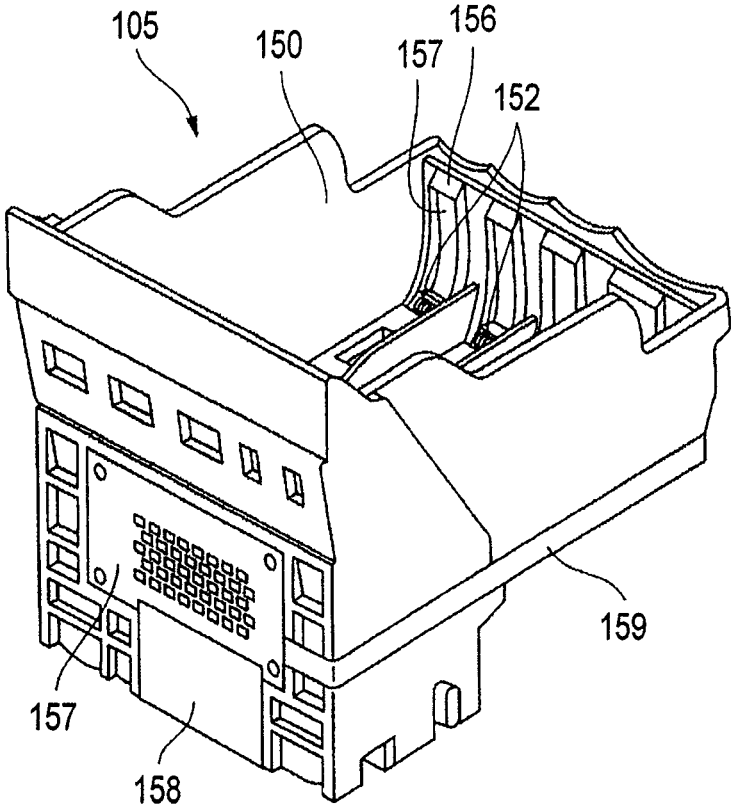
FIG. 5 is a perspective view of an example of a recording head unit structured so that the ink container in the first embodiment of the present invention can be removably mountable.
Figure 6:
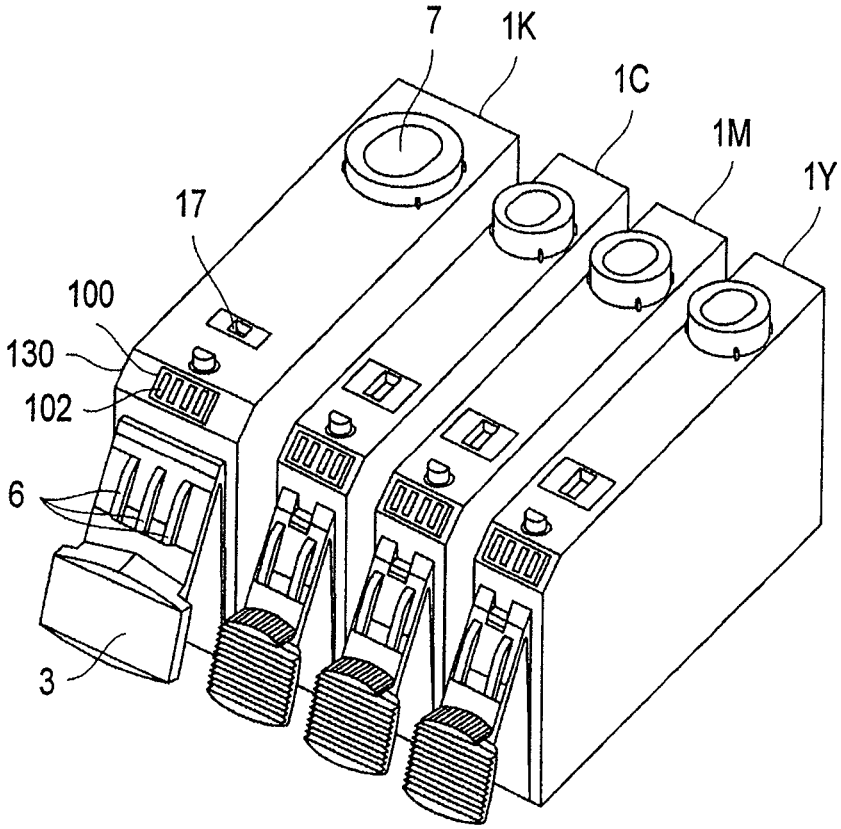
FIG. 6 is a perspective view of the set of ink containers removably mountable in the recording head unit shown in FIG. 5.
Figure 7:
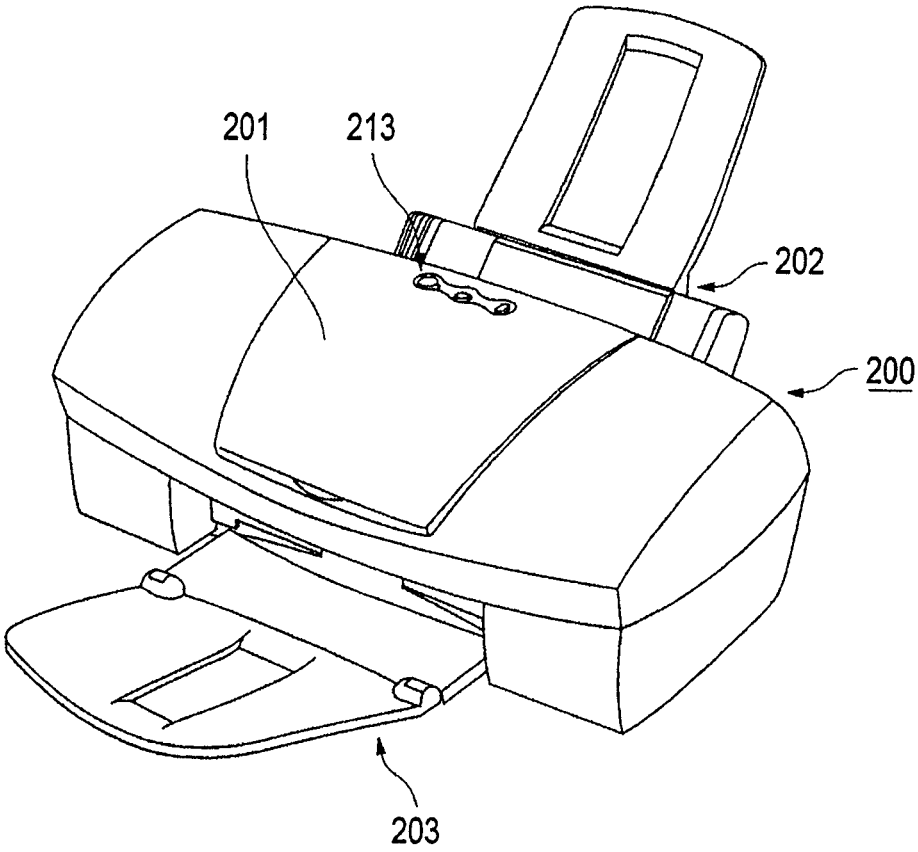
FIG. 7 is an external perspective view of an ink jet printer in which a recording head and an ink container are mounted to record.
Figure 8:
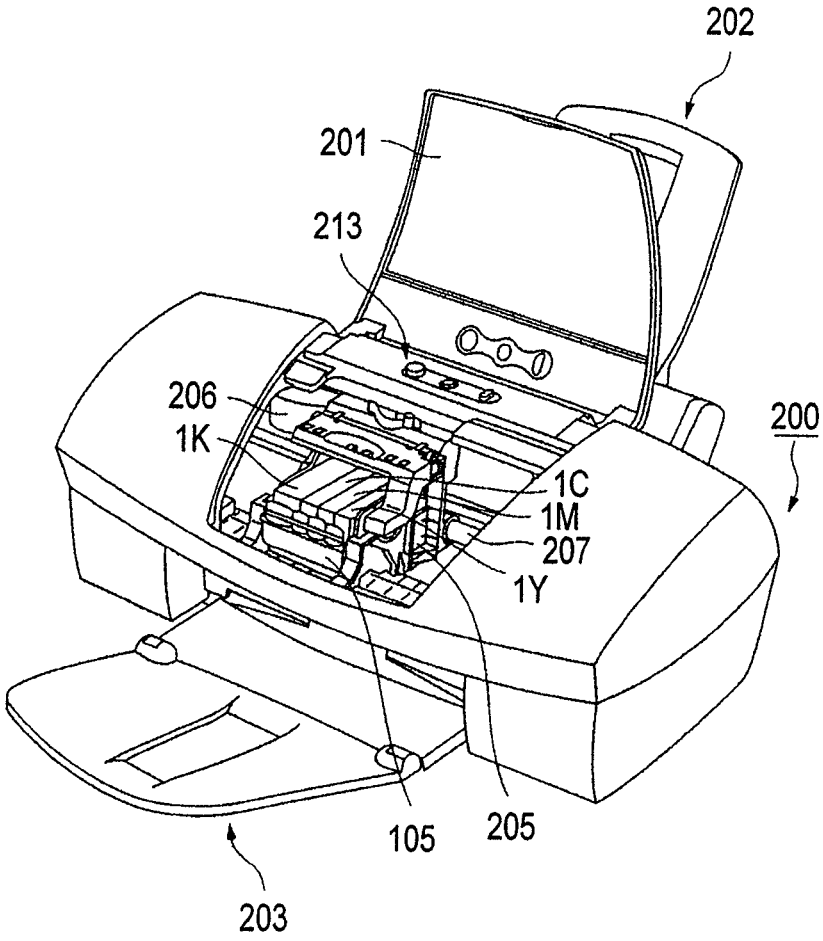
FIG. 8 is a perspective view of the ink jet printer shown in FIG. 7, the main assembly cover of which is open.

FIG. 5 is a perspective view of an example of a recording head unit structured so that the ink container in the first embodiment of the present invention is removably mountable, and FIG. 6 is a perspective view of a set of ink containers removably mountable in the recording head unit shown in FIG. 5. FIG. 7 is an external perspective view of an example of an ink jet recording apparatus in which the recording head unit shown in FIG. 5 and the set of ink containers shown in FIG. 6 are mounted for recording, and FIG. 8 is a perspective view of the ink jet recording apparatus shown in FIG. 7, the main assembly cover of which is open.

Generally, the recording head unit 105 is made up of the holder 150 for removably holding four ink containers 1K, 1C, 1M, and 1Y, which correspond to inks of black, cyan, magenta, and yellow colors, respectively, and the recording head 105*a* attached to the underside of the holder 150 to eject the four color inks. As any of the four ink containers is mounted into the holder 150, the ink outlet 7 of the ink container couples with the ink inlet 107 of the recording head attached to the underside of the recording head unit 105, creating an ink passage between the ink container and recording head unit 105.

As the recording head 105*a*, it is possible to employ a recording head in which electrothermal transducing elements are disposed within the nozzles (liquid paths), and the pressure resulting from the change in the phase of ink, that is, the pressure resulting from the bubbling (boiling) of ink, caused by the application of thermal energy generated by applying electrical pulse to the electrothermal transducing elements is used for ink ejection. As for the transmission of the electrical pulses to the electrothermal transducing elements of the recording head 105*a*, the electrical contacts (unshown), with which the carriage 205, which will be described later, is provided for the signal transmission are placed in contact with the electrical contacts portion 157 of the recording head unit 105, making it possible for recording signals to be transmitted through the wiring 158 to the circuit of the recording head 105*a* for driving the electrothermal transducing elements of the recording head unit 105. Designated by a referential number 159 is a set of wires extending from the electrical contacts 157 to the connector 152.

The four ink containers of the ink container set are virtually the same, except that they are different in the color of the inks they store, and also, that the ink container 1K for storing black ink is larger in the widthwise dimension than the other three. More specifically, each ink container has a latching lever 3 having an ink container anchoring second portion (rib) 6 attached to the front surface of the ink container 1, an ink outlet 7 with which the bottom wall of the ink container 1 is provided, an ink remainder amount detecting portion 17, in the form of a prism, with which the bottom wall of the ink container 1 is provided, a circuit board 100 and/or contact pad attached to the external surface of the slanted wall 130 connecting the bottom and front wall of the ink container 1, and an ink container anchoring first portion (projection, or rib) 5 projecting from the rear wall of the ink container. These ink containers 1K, 1C, 1M, and 1Y are removably and independently mountable in the holder 150.

FIG. 7 is an external perspective view of the ink jet printer 200 in which the above described ink containers are mounted for recording. FIG. 8 is an external perspective view of the ink jet printer 20, shown in FIG. 7, the main assembly cover of which is open.

Referring to FIG. 7, the printer 200 in this embodiment comprises a recording unit 105, ink containers 1, a main assembly, a delivery tray 203, and an automatic sheet feeding apparatus 202. The main assembly comprises: the carriage 205 on which the recording unit 105 and ink containers 1 are mounted; mechanism for reciprocally moving the carriage, for recording; a main assembly cover 201; and various portions of external casing, which cover the mechanism for reciprocally moving the carriage. It also comprise a display panel, which is visible whether the main assembly cover is open or closed, and a control panel 213 having a power switch and a reset switch.

Referring to FIG. 8, when the main assembly cover 201 is open, a user can see the recording head unit 105, ink containers 1K, 1Y, 1M, and 1C, carriage 205 having an IC, moving range of the carriage 205, and their adjacencies. In reality, as the main assembly cover 201 is opened, the sequence for moving the carriage 205 to roughly the center (which hereinafter may be referred to as container replacement position) of its moving range is automatically carried out, making it possible for the user to replace any or all of the ink containers.

The recording head unit 105 of the printer in this embodiment is provided with four recording heads 105*a* (FIG. 4) corresponding to four inks, one for one, different in color. Recording is made as the four recording heads 105*a* borne on the carriage 205 are reciprocally moved by the reciprocal movement of the carriage 205 along the surface of the recording medium such recording paper while ejecting ink in response to recording signals. More specifically, the carriage 205 is engaged with a guiding shaft 207 extended in the moving direction of the carriage 205, being enabled to slide along the guiding shaft 207, and is reciprocally moved by the combination of the carriage motor and driving force transmitting mechanism. The black, cyan, magenta, and yellow inks are ejected from the corresponding recording heads according to the ejection data sent from the control circuit of the main assembly through a flexible cable 206. Further, the main assembly is provided with a paper conveying mechanism comprising paper conveying rollers, discharge rollers, etc., being enabled to convey recording mediums (unshown) fed from the automatic sheet feeding apparatus 202, to the delivery tray 203. The carriage 205 is structured so that the recording head unit 105 integral with the ink container holder is removably mountable on the carriage 205. The ink containers 1 are removably mountable into the recording head 105.

As for the recording operation of this printer, while the recording head is moved by the above described movement of the carriage 205, in a manner to scan the surface of the recording medium, it ejects ink therefrom, recording thereby on the recording medium by a predetermined width matching the length of the line of ejection orifices of the recording head. During the interval between a given scanning movement of the recording head unit 105 in the direction perpendicular to the direction in which recording medium is to be conveyed, and the following scanning movement of the recording head unit 105, the recording medium is conveyed in the direction perpendicular to the direction in which the recording head unit 105 is reciprocally moved, by a distance equal to the scanning width of the recording head unit 105 in terms of the direction parallel to the recording medium conveyance direction. As a result, recording is incrementally made on the recording medium by the width equal to the scanning width of the recording head unit 105. The main assembly is provided with an ejection performance recovery unit comprising a cap for covering the surface of each recording head having the ejection orifices. The ejection performance recovery unit is located at one end of the range across which the recording head unit 105 is moved by the movement of the carriage 205. The recording head unit 105 is moved for every predetermined length of time to the position in which it opposes the recovery unit, and in which it is subjected to the performance recovery procedure such as preliminary ejection.

The number of ink containers employed by an ink jet recording head, manner in which color ink is stored in an ink container, structures of a recording head and an ink jet recording apparatus to which ink containers are attached, do not need to be limited to the above described ones.

Figure 9:
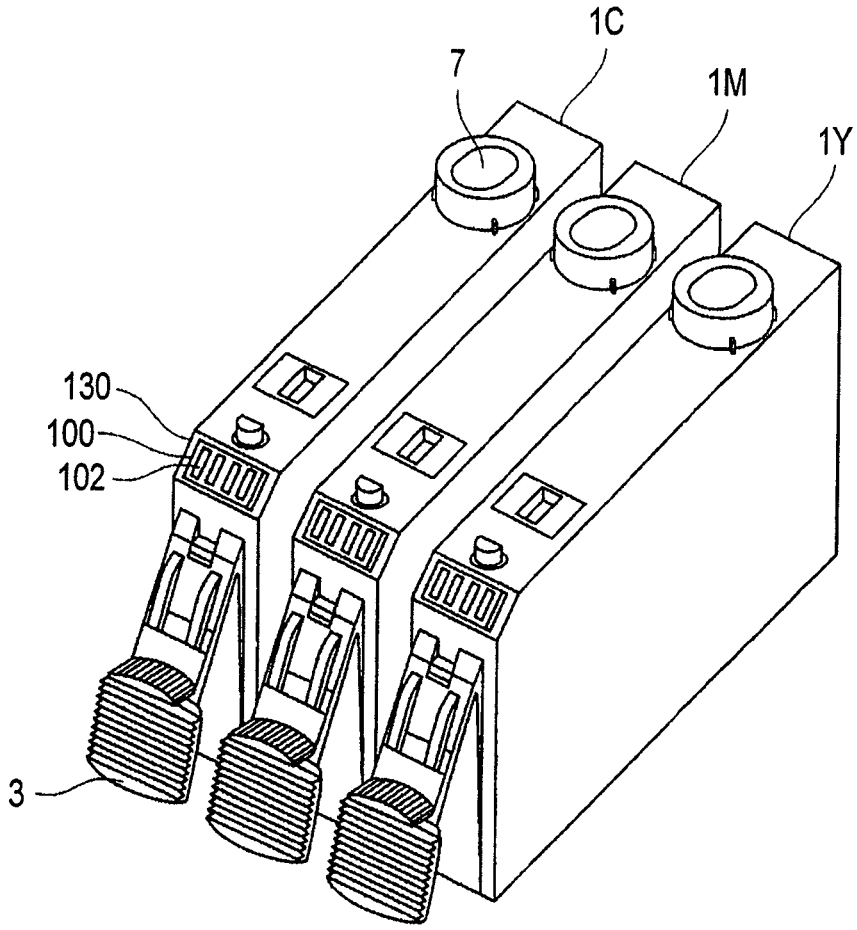
FIG. 9 is a perspective view of a set of ink containers different from the set shown in FIG. 6.
Figure 10:
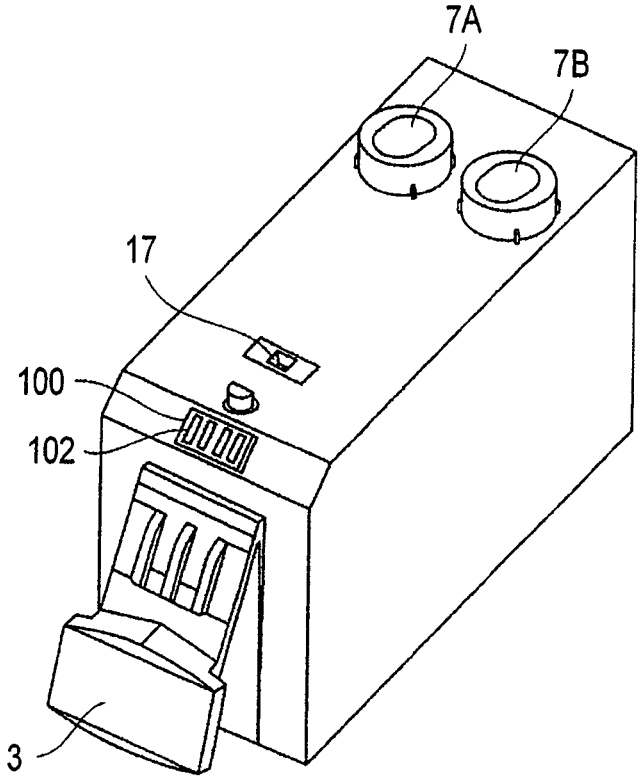
FIG. 10 is a perspective view of one of the modified versions of the ink container in the first embodiment.
Figure 11:
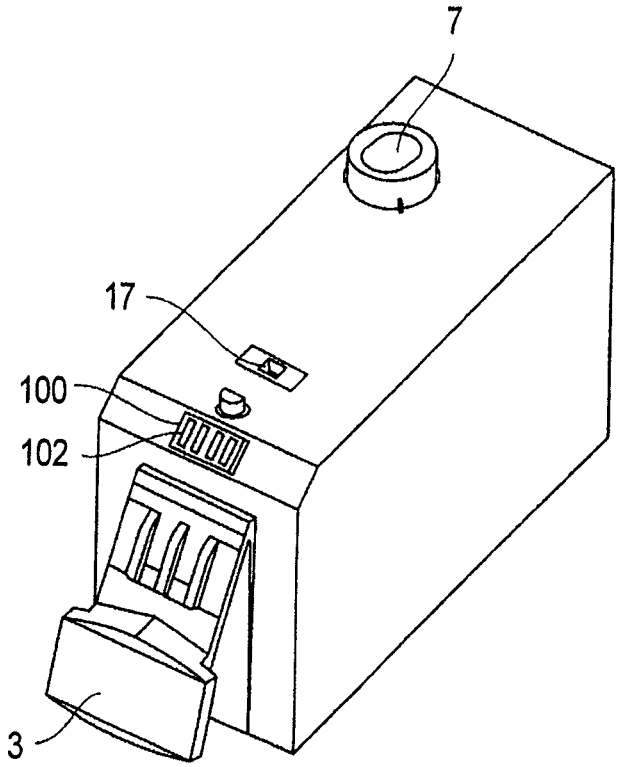
FIG. 11 is a perspective view of another modified version of the ink container in the first embodiment.

For example, referring to FIG. 9, an ink jet recording apparatus may be structured so that three (for example, three containers for cyan, magenta, and yellow inks, one for one) of the four color ink containers such as those in the first embodiment are mounted in the same holder, or attached to the same recording head unit. Further, referring to FIG. 10, an ink container may be provided with two ink outlets 7A and 7B. In this case, the internal space of the ink container may be divided into two separate ink chambers, in which two inks different in tone are stored one for one. In this case, obviously, the structures of the holder and recording head unit have to be modified to accommodate such an ink container. Further, referring to FIG. 11, the ink outlet of an ink container may be off-center, as long as it can be satisfactorily connected to the ink inlet of a recording head unit.

Regarding the tone of ink, single ink with a specific tone, or two or more inks which are identical in color, but different in tone, may be used. When using multiple inks different in color, the number of inks different in color may be four as it was in the above described embodiment, or may be just three. Further, two or more inks which are the same in color, but different in tone, may be employed for each color component, in addition to, or in place of, inks different in color; for example, cyan and magenta inks which are lighter in tone. Further, inks different in color from the abovementioned ones may be employed in addition to the abovementioned one; for example, red, green, and blue inks. Regarding the type of liquid to be stored in an ink container, such ink (liquid) that contains ingredients for better fixing an image to recording medium, improving color development, and/or improving image durability, may be stored, in addition to the ordinary ink, that is, liquid which contains coloring ingredients.

2. Additional Embodiments

The above described embodiment of the present invention is not intended to limit the scope of the present invention. Rather, the present invention can be embodied in various forms within the intent of the present invention.

In the above described first embodiment, the ink container is provided with a springy latching member as the ink container anchoring second member which extends diagonally upward from the bottom portion of the external surface of the front wall of the ink container. As the ink container is mounted into the holder, the latching member is elastically deformed by the force applied to mount the ink container into the holder, keeping thereby the ink container pressured toward a predetermined referential point for mounting the ink container. However, the position, shape, direction in which force is generated by the latching member, of the latching member are optional.

Figure 12:
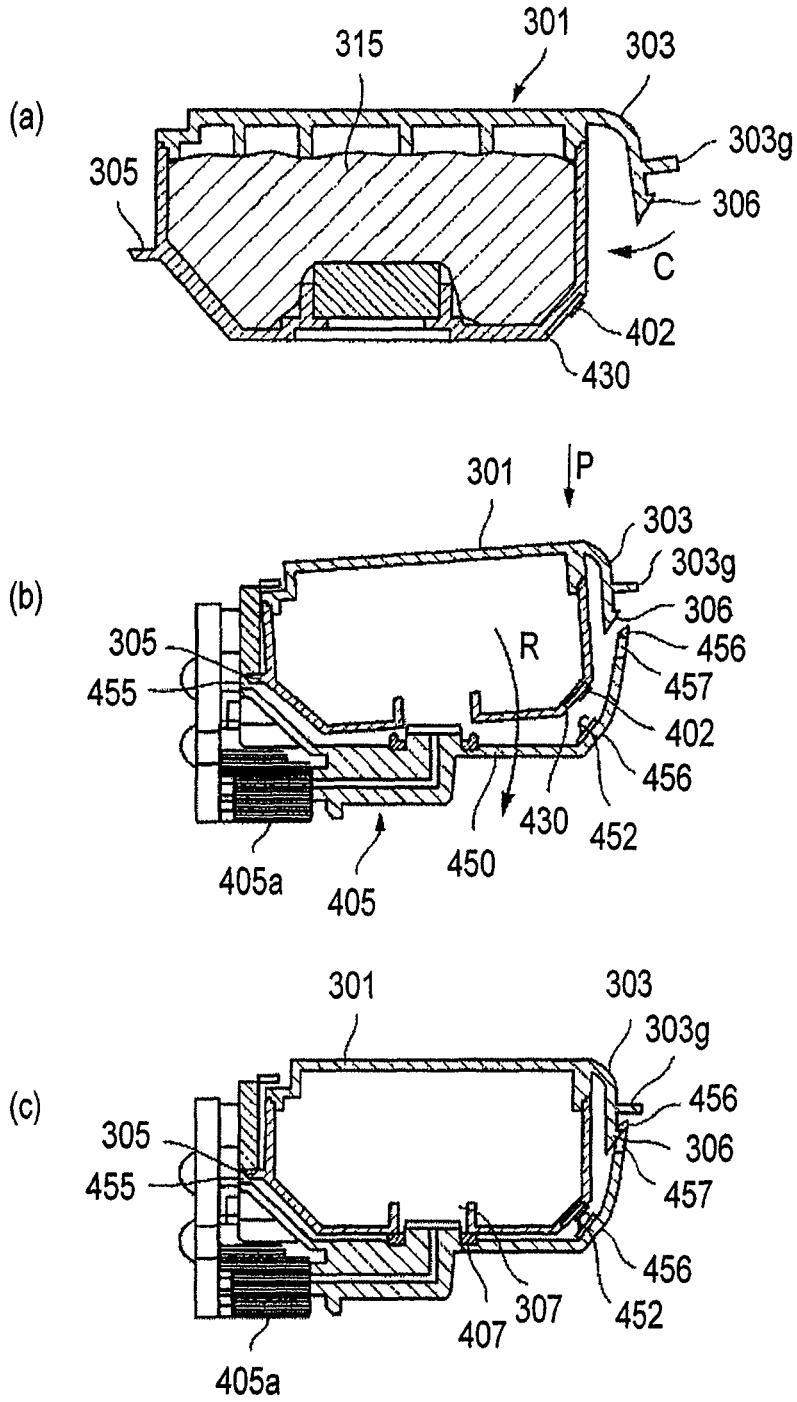
FIGS. 12(*a*)-12(*c*) are schematic drawings for describing the another structural arrangement and the procedure for elastically pressing an ink container into the predetermined position in the recording head unit.

FIGS. 12(*a*)-(*c*) are schematic sectional views of the combination of the ink container and holder in another embodiment of the present invention, showing the springy latching member thereof for keeping the ink container pressured toward the predetermined referential point for mounting the ink container, being different in structure from the one in the first embodiment, and also, showing the operation for mounting the ink container into the holder. In the case of this combination, the latching member 303 as a member for keeping the ink container 301 pressured toward the predetermined referential point extends diagonally downward from the top end portion of the front wall of the ink container 301 to take the force applied to mount the ink container. The latching member 303 is resiliently deformable in the direction indicated by an arrow mark c in FIG. 12(*a*).

The ink container 301 is also provided with an ink container anchoring first portion 305, which is on the external surface of the back wall of the ink container 301, and an ink container anchoring second portion 306, which is on the free end portion of the latching member 303. Designated by a referential symbol 303*g* is a rib which can be used by a user to manipulate the ink container 301 when the user mounts the ink container 303. The bottom wall of the ink container 301 is provided with an ink outlet 307. The bottom portion of the front end of the ink container 301 are structured so that the front and bottom walls of the ink container 301 are connected by a slanted wall 430, to the external surface of which a circuit board and a contact pad are attached. In FIG. 12(*a*), the virtually the entirety of the internal space of the ink container 301 is filled with a porous member 315 capable of absorbing and retaining ink, although the ink container 301 may be structured so that the porous member 315 occupies a part of the internal space of the ink container 301 as in the first embodiment. Referring to FIGS. 12(*b*) and 12(*c*), the recording head unit 405 in this embodiment is structured so that its ink passage between the ink inlet 407 and the recording head 405*a* vertically extends downward from the ink inlet 405 and then, horizontally bends, and also, so that the ink is virtually horizontally ejected from the recording head 405. However, the direction in which ink is to be ejected is optional.

The procedure for mounting the ink container 301 into the holder 450 of the recording head unit 405 is as follows: First, the ink container 301 is to be inserted into the ink holder 450 from above (FIG. 4(*a*)) so that the ink container anchoring first portion 305 in the form of a projection is put through the ink container anchoring portion 455, that is, a through hole, of the holder 450. Then, the ink container 301 is to be pushed down in the direction indicated by an arrow mark P by the top end of the front wall of the ink container 301, with the latching lever 303 being rotating in the direction indicated by an arrow mark c by pressing the rib 303*g* in order to prevent the ink container anchoring second portion 306 from interfering with the ink container anchoring second portion 456 of the holder 450. Further, in order to allow the ink container 303 to smoothly rotate about the ink container anchoring first portion 305 in the direction indicated by an arrow mark R, it is possible to have the tip of the ink container anchoring second portion 306 and the tip of the ink container anchoring second portion 456 chamfered.

As the ink container anchoring second portion 306 is lowered to the recess 457 located below the ink container anchoring second portion 456, the former is fitted into the latter by the resiliency of the latching lever 303, anchoring thereby the ink container 301 while the resiliency of the latching lever 303 keeping the ink container 301 pressured toward the back wall of the holder 450, keeping thereby the ink container in contact with the back wall of the holder 450. During this process of mounting the ink container 301 into the holder 450, which is similar to that in the first embodiment, the ink outlet 307 of the ink container 301 is coupled with the ink inlet 407 of the recording head unit (holder 450), and the circuit board or contact pad 402 disposed on the external surface of the slanted wall 430 of the ink container 301 is reliably placed in contact with the connector 452 disposed on the internal surface of the slanted wall portion 456 of the recording head unit (holder 450).

Figure 13:
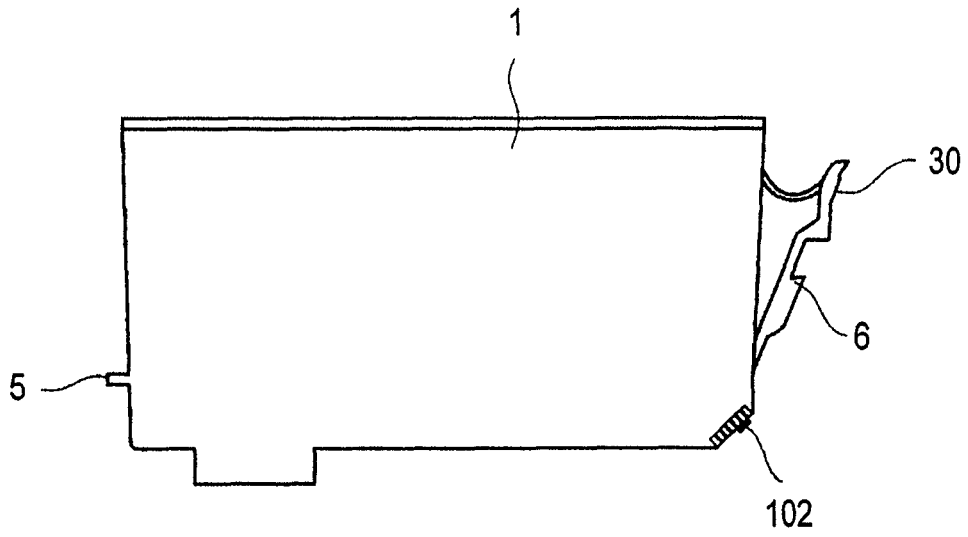
FIG. 13 is a schematic side view of the ink container in another embodiment of the present invention.

The shape of the springy member, or latching lever, for keeping the ink container pressured does not need to be in the form of a cantilever like the one in the second embodiment; it is optional. FIG. 13 shows one of the optional forms for the springy member. In this case, the springy latching lever 30 is virtually the same in shape as the latching lever 3 in the first embodiment, having the ink container anchoring second portion 6, except that the free end of the latching lever 30 is connected to the ink container 301 with a flexible member.

In the preceding embodiments, the resilient latching levers were structured so that the ink container was pressured by the resiliency of the latching lever straight toward the referential point (ink container anchoring first portion of holder, or internal surface of back wall of holder) for mounting an ink container. However, the direction in which pressure is to be applied by the resiliency of the latching member is optional; it should be determined according to the position, structure, etc., of the referential portion.

Figure 14:
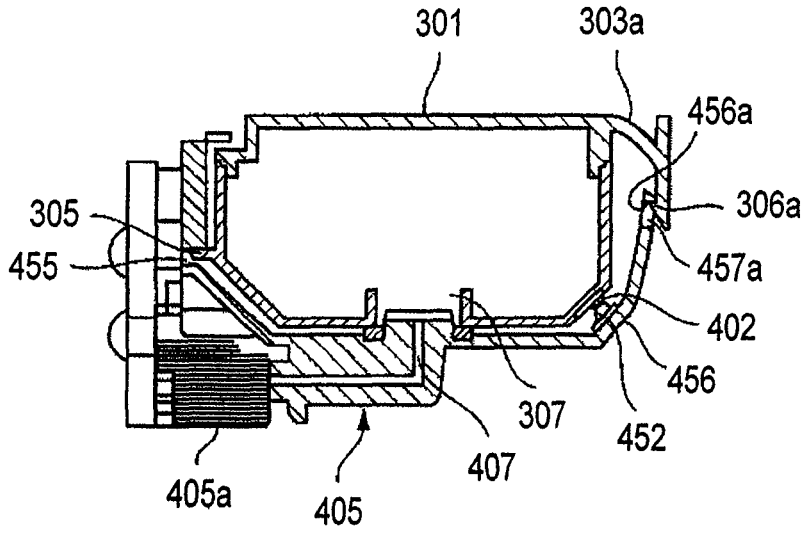
FIG. 14 is a sectional view of the ink container, and the ink container mount (holder) therefor, in another embodiment of the present invention.

FIG. 14 shows one of the optional structural arrangements for an ink container and holder therefor. It is roughly the same as the one shown in FIG. 12, except that the latching portion 306*a* as the ink container anchoring second portion of the latching lever 303*a* of the ink container 301, and the ink container anchoring second portion 456*a* of the holder 450, are structured so that the former fits into the recess 457*a* of the latter from outward side of the holder to anchor the ink container 301 to the holder.

Further, in the preceding embodiments, the ink container was to be inserted vertically downward into the holder. However, the direction in which the ink container is to be inserted is also optional.

Figure 15:
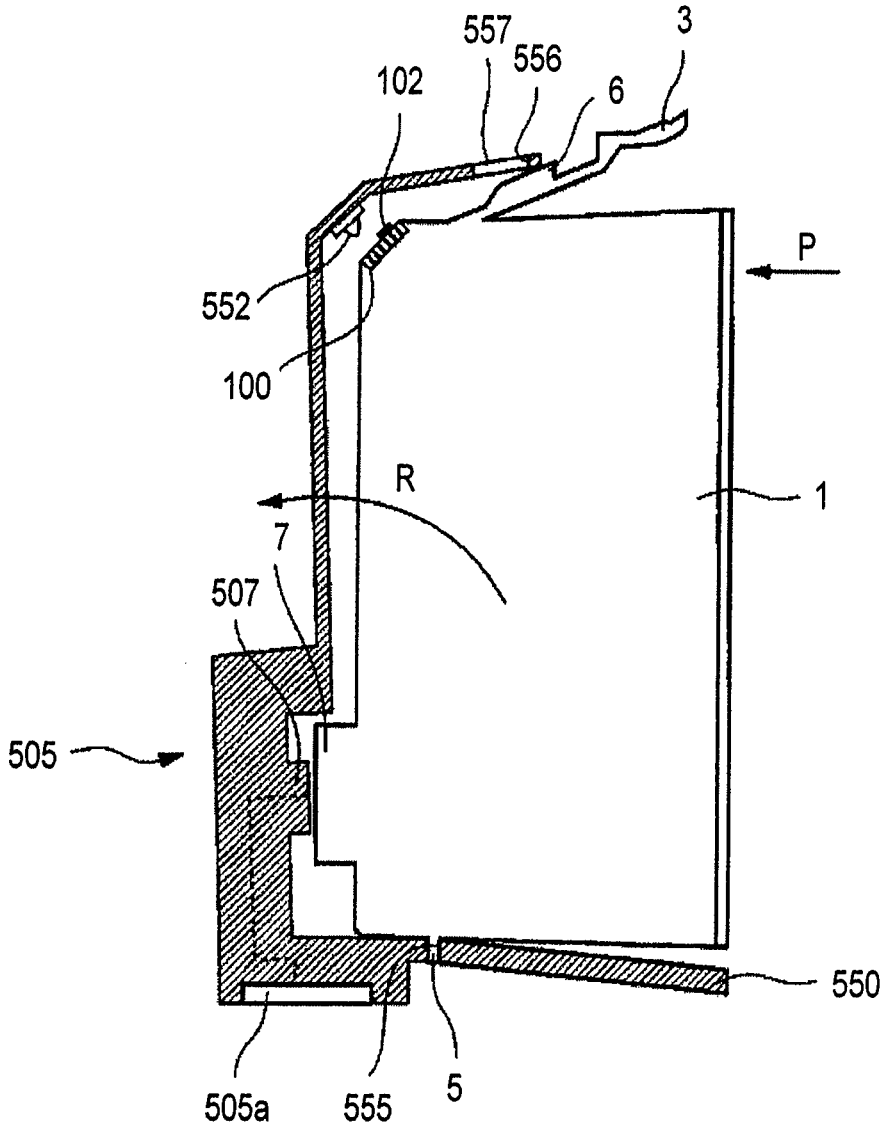
FIG. 15 is a schematic sectional view of one of the modified versions of the ink container mount (holder) in the first embodiment, at a plane parallel to the side walls thereof, showing the structure thereof.

FIG. 15 shows one of these options. In this case, the ink container 1 identical in structure to the one in the first embodiment is to be horizontally pushed into the holder 550 of the recording head unit 505. The positional relationship between the various portions of the ink container and the ink container anchoring first portion 5 is the same as that in the first embodiment, and so are the manner in which the contact pad 102 is placed in contact with the connector 552 of the holder through the rotational movement of the ink container 1 in the direction indicated by an arrow mark R about the ink container anchoring first portion 5 put through the ink container anchoring first portion of the holder, the manner in which the ink outlet 7 of the ink container 1 is coupled with the ink inlet 507 of the recording head unit 505, and the manner in which the ink container anchoring second portion 6 of the ink container 1 fits into the recess 157 of the back wall of the holder 550, are also the same as those in the first embodiment. Incidentally, this recording head unit 505 ejects ink vertically downward, and the ink passage from the ink inlet 507 of the recording head unit 505 to the recording head 505*a* is bent as indicated by the dotted line.

Also in the case of the structural arrangement shown in FIG. 15, the contact pad 102 is located above the level of the point of ink leakage from the ink outlet 7, eliminating the possibility that the leaked ink will travel to the contact pad 102.

Further, in the preceding embodiments, the springy latching member for keeping the ink container pressured toward the referential portion for mounting the ink container is provided on the ink container side. However, it may be a third member independent from the ink container and recording head unit. More specifically, it may be such an independent member which is V-shaped in cross section, having a first arm portion which is to be placed in contact with the external surface of the front wall of an ink container and has a latching portion, and a second arm portion which has a latching portion to latch with the catch portion on the internal surface of the front wall of the holder. The amount of its resiliency is determined by the angle formed by the two arm portions. It is to be inserted into the gap between the front wall of the ink container and the front wall of the holder, at the end of the process of mounting the ink container. Or, it may be such an independent third member as the one disclosed in Japanese Laid-open Patent Application 8-230206, which is independent from an ink container, and keeps the ink container pressured downward in coordination with a recording head unit.

Figure 16:
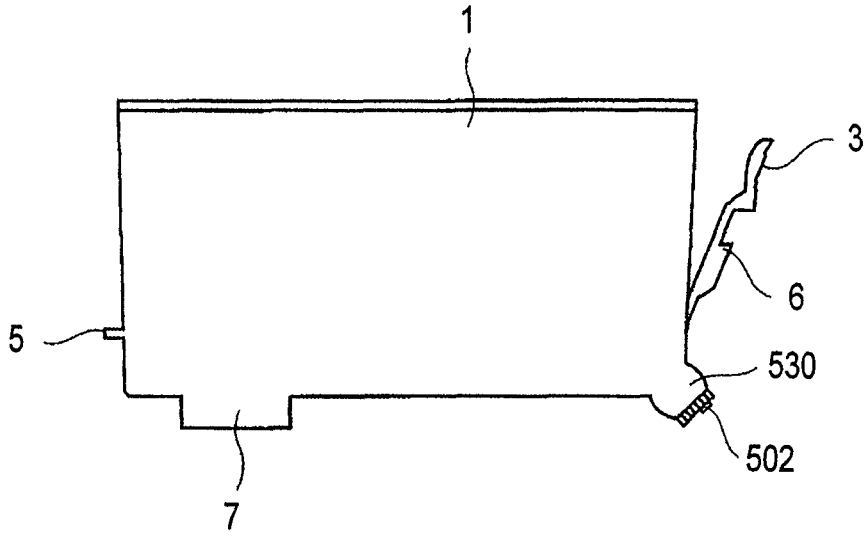
FIG. 16 is a schematic sectional view of the ink container mount (holder) in another embodiment, at a plane parallel to the side walls thereof, showing the structure thereof.

Also in the preceding embodiments, the circuit board or contact pad was disposed on the external surface of the slanted connective wall, which appears as if it were formed by chamfering the bottom front corner of the ink container, between the front and bottom walls of the ink container. However, as long as the force applied to the ink container to mount the ink container can be made to act in the proper direction to establish reliable electrical connection between the ink container and holder, and as long as ink leakage is not concerned, the ink container 1 may be provided with an contact pad mount protruding from the edge between the top and bottom walls of the ink container, as shown in FIG. 16, and the contact pad 502 may be disposed on the end surface of the contact pad mount.

Also in the preceding embodiments, the information storage element was disposed on the opposite surface of the circuit board from the surface on which the contact pad is located. However, the information storage element and contact pad may be disposed on the same surface of the circuit board, as long as the information storage element does not interfere while the contact pad is being placed with the connector of the recording head unit. Further, if the preferable location for the circuit board or information storage element is different from the preferable location for the contact pad because of the structure of the ink container and/or the portions thereof for attaching the ink container, the circuit board with the information storage element and the contact pad may be separately disposed on the optimal locations therefor, and connected with wiring. In other words, it is not mandatory that both the information storage and the contact pad are integrally placed on the circuit board.

Also in the preceding embodiments, the ink container was removably mounted into the recording head unit having the ink container holder. However, the ink container and recording head may be structured to be inseparable. In such a case, the inseparable combination of ink container and recording head is removably mounted in the carriage. The structural arrangement, in the preceding embodiment, for the electrical contacts through which recording signals are transmitted to the recording head, and also, through which the electrical signal reflecting the conditions of the ink container and recording head are exchanged between the combination of the ink container and recording head, and the main assembly, in order to display the conditions, is also applicable, with just as preferable results as those obtained by the preceding embodiments, to the inseparable combination of an ink container and recording head, and the holder therefor.

Also in the preceding embodiments, the information regarding the ink containers was displayed through the electrical connection between the ink container and main assembly of an ink jet recording apparatus. However, the present invention is also applicable to any mechanical connection, as long as the information regarding the ink containers can be displayed to a user through the mechanical contact between the electrical contacts of the ink containers and those of the main assembly. For example, the mechanical contact between the ink container and main assembly may be for magnetically transmitting information. In such a case, the contact pad is replaced with a magnetic storage means, and the connector is replaced with a magnetic head.

The preceding embodiments are not intended to limit the structures of the anchoring portions of the ink container and the structure of the holder, to those in the embodiments. For example, instead of providing the holder of the recording head unit with the ink container anchoring second portion and connector, the carriage may be provided with the ink container anchoring second portion and connector. In other words, the ink container anchoring second portion 156, connector 152, and wiring 159 for the connector, may be attached to the carriage. In the case of such a structural arrangement, as the recording head unit is mounted into the carriage, the entirety of the anchoring portion of the ink container is realized, and the process of coupling the ink outlet with the ink inlet, and the process of placing the pad in contact with the connector, are completed through the same movement of the ink container as that shown in FIG. 4.

Further, the addition of the following features, which will be described next, to the ink container in accordance with the present invention further improves an ink jet printer in usability.

Generally, an ink container is filled with ordinary ink. The ink to be filled into an ink container may be pigment ink or dye ink. The color of the ink to be filled into an ink container may be red, green, blue, etc., in addition to black, yellow, magenta, and cyan. Regarding the tone of ink, cyan and magenta inks lighter in tone than the ordinary cyan and magenta inks may be employed in addition to the abovementioned ones. Further, an ink container may be filled with solution for treating ink and/recording medium for improving ink and recording medium in fixation, color development, durability, and the like properties.

An ink jet printer designed so that it can employ three to eight ink containers among the abovementioned ink containers different in the color and tone of the inks they store can yield an image comparable to a photographic image.

Incidentally, in the case of an ink container, such as the one shown in FIG. 3, the internal space of which is divided into a first chamber in which ink is directly stored, and a second chamber in which ink is stored in the ink absorbent member packed in the chamber, if the ink absorbent member is made up of two pieces of ink absorbent members which are vertically stacked (interface of which is located above passage through which gas (air) is introduced from the second chamber to the first chamber), the ink container is desired to be filled with ink by an amount enough for the ink to completely fill the entirety of the bottom piece of the absorbent member and reach the interface between the top and bottom pieces. Filling the ink container by the amount described above can prevent the occurrence of such a situation, during the distribution of an ink container, that the ink in the first chamber travels into the second chamber and leaks out of the ink container through the air vent of the ink container.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 435940/2003 filed Dec. 26, 2003, which is hereby incorporated by reference.

What is claimed is:

1. An ink container comprising:

a casing including an ink chamber configured to contain an ink and having an ink supply port configured to supply the ink in the ink chamber to an outside of the casing, the casing having a bottom wall having the ink supply port, a top wall and a plurality of side walls, the bottom wall, the top wall and the plurality of side walls being defined by orientation in a state that the ink container is oriented with the ink supply port facing downward, the plurality of side walls having a first side wall and a second side wall opposed to the first side wall;

a first engaging projection provided on the first side wall;

a second engaging projection closer to the second side wall than to the first side wall; and an electrical contact closer to the bottom wall than to the top wall and closer to the second side wall than to the first side wall, the electrical contact being inclined relative to the bottom wall and the second side wall.

2. The ink container according to claim 1, further comprising a substrate provided with the electrical contact, wherein the casing has a supporting portion supporting the substrate so that the electrical contact is inclined relative to the bottom wall and the second side wall.

3. The ink container according to claim 2, wherein the casing has a connecting portion connecting the bottom wall with the second side wall, wherein the connecting portion includes an inclined part which is inclined relative to the bottom wall and the second side wall and which functions as the supporting portion.

4. The ink container according to claim 3, wherein the supply port is closer to the first engaging projection than to the second engaging projection.

5. The ink container according to claim 4, wherein in a state that the ink container is oriented with the ink supply port facing downward, the electrical contact is between the ink supply port and the second engaging projection when the ink container is viewed from below.

6. The ink container according to claim 5, wherein in a state that the ink container is oriented with the ink supply port facing downward, the electrical contact is lower than the second engaging projection and higher than the bottom wall.

7. The ink container according to claim 6, wherein the inclined part extends in an inclined direction which is inclined relative to the bottom wall and the second side wall, and wherein the electrical contact is elongated in the inclined direction.

8. The ink container according to claim 7, further comprising a second electrical contact provided on the substrate and elongated in the inclined direction, a third electrical contact provided on the substrate and elongated in the inclined direction, and a fourth electrical contact provided on the substrate and elongated in the inclined direction, wherein the inclined part has a width in a width direction perpendicular to the inclined direction, and wherein the electrical contact, the second electrical contact, the third electrical contact and the fourth electrical contact are arranged in the width direction.

9. The ink container according to claim 8, wherein the plurality of side walls has (i) a third side wall connecting with the bottom wall, the top wall, the first side wall and the second side wall, the third side wall being larger than each of first side wall and the second side wall and being perpendicular to the width direction, and (ii) a fourth side wall opposed to the third side wall and connecting with the bottom wall, the top wall, the first side wall and the second side wall, the fourth side wall being larger than each of first side wall and the second side wall and being perpendicular to the width direction.

10. The ink container according to claim 9, further comprising an elastically deformable lever supported by the casing and provided with the second engaging projection.

11. The ink container according to claim 10, wherein the elastically deformable lever is supported by the second side wall.

12. The ink container according to claim 1, wherein in a state that the ink container is oriented with the ink supply port facing downward, the electrical contact is between the ink supply port and the second engaging projection when the ink container is viewed from below.

13. The ink container according to claim 12, wherein in a state that the ink container is oriented with the ink supply port facing downward, the electrical contact is lower than the second engaging projection and higher than the bottom wall.

14. The ink container according to claim 1, wherein the supply port is closer to the first engaging projection than to the second engaging projection, and wherein the electrical contact is closer to the second engaging projection than to the first engaging projection.

15. The ink container according to claim 14, wherein the information stored by the memory includes at least one of a color of the ink, a remaining amount of the ink, a usage amount of the ink usage, and an expiration date of the ink.

16. An ink container comprising:

a casing including an ink chamber configured to contain an ink and having an ink supply port configured to supply the ink in the ink chamber to an outside of the casing, the casing having (i) a bottom wall having the ink supply port, (ii) a top wall, (iii) a plurality of side walls having (iii-i) a first side wall, (iii-ii) a second side wall opposed to the first side wall, (iii-iii) a third side wall connecting with the bottom wall, the top wall, the first side wall and the second side wall, the third side wall being larger than each of the first side wall and the second side wall, and (iii-iv) a fourth side wall opposed to the third side wall and connecting with the bottom wall, the top wall, the first side wall and the second side wall, the fourth side wall being larger than each of the first side wall and the second side wall, and (iv) a connecting portion connecting the bottom wall with the second side wall and including an inclined part which is inclined relative to the bottom wall and the second side wall, wherein the bottom wall, the top wall and the plurality of side walls are defined by orientation in a state that the ink container is oriented with the ink supply port facing downward, and wherein the supply port is closer to the first side wall than to the second side wall;

a first engaging projection provided on the first side wall;

a second engaging projection closer to the second side wall than to the first side wall;

a plurality of electrical contacts;

a memory configured to store an information regarding to the ink container; and a circuit board provided on the inclined part, and provided with the plurality of electrical contacts and the memory.

17. The ink container according to claim 16, wherein the plurality of electrical contacts includes at least four elongated electrical contacts, each extending an inclined direction which is inclined relative to the bottom wall and the second side wall.

18. The ink container according to claim 17, wherein the four electrical contacts are arranged in a direction which is perpendicular to the inclined direction and which is perpendicular to the third side wall and the fourth side wall.

19. The ink container according to claim 18, further comprising an elastically deformable lever supported by the casing and having the second engaging projection.

20. An ink container comprising:

a casing including an ink chamber configured to contain an ink and having an ink supply port configured to supply the ink in the ink chamber to an outside of the casing, the casing having (i) a first wall having the ink supply port, (ii) a second wall opposed to the first wall, (iii) a third wall connecting the first wall with the second wall, (iv) a fourth wall opposed to the third wall, (v) a fifth wall connecting with the first, second, third and fourth walls, and (vi) a sixth wall opposed to the fifth wall and connecting with the first, second, third and fourth walls;

a first engaging projection provided on the third wall;

a second engaging projection closer to the fourth wall than to the third wall; and an electrical contact closer to the first wall than to the second wall and closer to the fourth wall than to the third wall, the electrical contact being inclined relative to the first wall and the fourth wall.

21. The ink container according to claim 20, wherein the electrical contact is between the ink supply port and the second engaging projection when viewed facing the ink supply port.

22. The ink container according to claim 21, wherein in a state that the ink container is oriented with the ink supply port facing downward, the electrical contact is higher than the first surface and lower than the second engaging portion.

23. The ink container according to claim 22, wherein the supply port is closer to the first engaging projection than to the second engaging projection.

24. The ink container according to claim 23, wherein the electrical contact is closer to the second engaging projection than to the first engaging projection.

25. The ink container according to claim 24, further comprising a substrate provided with the electrical contact, wherein the casing has a supporting portion supporting the substrate so that the electrical contact is inclined relative to the first wall and the fourth wall.

26. The ink container according to claim 25, wherein the casing has a connecting portion connecting the first wall with the fourth wall, and wherein the connecting portion includes an inclined part which is inclined relative to the first wall and the fourth wall and which functions as the supporting portion.

27. The ink container according to claim 26, wherein in a state that the ink container is oriented with the ink supply port facing downward, the first wall is a bottom wall, the second wall is a top wall, and the third, fourth, fifth, and sixth walls are side walls, and wherein the inclined part is higher than the bottom wall and lower than the top wall.

28. The ink container according to claim 27, wherein the fifth wall is larger than each of the third and fourth walls, and the sixth wall is larger than each of the third and fourth walls.

* * * * *